US007614197B2

(12) United States Patent
Nelson

(10) Patent No.: US 7,614,197 B2
(45) Date of Patent: Nov. 10, 2009

(54) LAMINATE FLOORING

(75) Inventor: Thomas J. Nelson, Belton, TX (US)

(73) Assignee: Premark RWP Holdings, Inc., Wilmington, DE (US)

( * ) Notice: Subject to any disclaimer, the term of this patent is extended or adjusted under 35 U.S.C. 154(b) by 548 days.

(21) Appl. No.: 10/706,947

(22) Filed: Nov. 14, 2003

(65) Prior Publication Data

US 2004/0244325 A1 Dec. 9, 2004

Related U.S. Application Data

(60) Continuation-in-part of application No. 09/941,500, filed on Aug. 29, 2001, now abandoned, which is a division of application No. 09/436,317, filed on Nov. 8, 1999, now Pat. No. 6,460,306, application No. 10/706,947, which is a continuation-in-part of application No. 10/265,900, filed on Oct. 7, 2002, now Pat. No. 6,769,217, which is a continuation of application No. 09/436,317, filed on Nov. 8, 1999, now Pat. No. 6,460,306.

(51) Int. Cl.
*E04B 2/00* (2006.01)

(52) U.S. Cl. ..... 52/582.1; 52/461; 52/506.05

(58) Field of Classification Search ..... 52/582.1, 52/391, 384, 506.06, 506.07, 506.1, 730.6, 52/731.7, 461, 464, 468, 582.2, 506.08, 506.09, 52/589.1, 592.3, 772; 403/286, 292, 294
See application file for complete search history.

(56) References Cited

U.S. PATENT DOCUMENTS

| | | | |
|---|---|---|---|
| 753,791 | A | 3/1904 | Fulghum |
| 1,124,228 | A | 1/1915 | Houston |
| 1,417,010 | A | 5/1922 | Wright et al. |
| 1,430,996 | A | 10/1922 | Horlin |
| 1,859,667 | A | 5/1932 | Gruner |
| 1,888,611 | A | 11/1932 | Wolfson |
| 1,889,138 | A | 11/1932 | Wolfson |

(Continued)

FOREIGN PATENT DOCUMENTS

| | | |
|---|---|---|
| FR | 1 572 046 | 5/1969 |

(Continued)

*Primary Examiner*—Richard E Chilcot, Jr.
*Assistant Examiner*—William V Gilbert
(74) *Attorney, Agent, or Firm*—Welsh & Flaxman LLC

(57) ABSTRACT

A disengageable connector for interconnecting panels includes a longitudinally extending connector body. The connector body including a base and a projection extending from the base. The base includes a top surface and a bottom surface, and at least one footing member extending downwardly from the bottom surface of the base. The footing member is shaped and dimensioned to compress the upper surface of a resilient pad positioned beneath the connector and the panels. The connector is used in conjunction with an interlocking flooring system. The interlocking flooring system includes a plurality of flooring panels, each flooring panel including a plurality of edges. A first connecting member is provided for connecting adjacent flooring panels and a second connecting member is provided for connecting adjacent flooring panels. The first connecting member is the same as the connector described above and is different from the second connecting member. The first connecting member provides greater resistance to disengagement of adjacent flooring panels when compared to the second connecting member.

3 Claims, 22 Drawing Sheets

U.S. PATENT DOCUMENTS

| | | | | | |
|---|---|---|---|---|---|
| 1,916,748 | A | | 7/1933 | Wright | |
| 1,946,646 | A | | 2/1934 | Storm | |
| 1,988,201 | A | | 1/1935 | Hall | |
| 1,995,264 | A | | 3/1935 | Mason | |
| 2,000,226 | A | | 5/1935 | Fry | |
| 2,142,305 | A | | 1/1939 | Davis | |
| 2,204,675 | A | | 6/1940 | Grunert | |
| 2,266,464 | A | | 12/1941 | Kraft | |
| 2,430,200 | A | | 11/1947 | Wilson | |
| 2,453,918 | A | | 11/1948 | Jansen | |
| 2,671,538 | A | | 3/1954 | Horowitz et al. | |
| 2,740,167 | A | | 4/1956 | Rowley | |
| 2,996,751 | A | | 8/1961 | Roby et al. | |
| 3,045,294 | A | | 7/1962 | Livezey, Jr. | |
| 3,100,556 | A | | 8/1963 | DeRidder | |
| 3,111,205 | A | | 11/1963 | Gresham | |
| 3,128,851 | A | | 4/1964 | DeRidder et al. | |
| 3,182,769 | A | | 5/1965 | DeRidder | |
| 3,310,919 | A | | 3/1967 | Bue et al. | |
| 3,385,182 | A | | 5/1968 | Harvey | |
| 3,508,369 | A | | 4/1970 | Tennison | 52/396 |
| 3,526,420 | A | | 9/1970 | Brancaleone | |
| 3,538,665 | A | | 11/1970 | Gohner | |
| 3,570,205 | A | | 3/1971 | Payne | 52/466 |
| 3,590,545 | A | | 7/1971 | Webb | |
| 3,614,915 | A | * | 10/1971 | Perry | 404/40 |
| 3,657,852 | A | | 4/1972 | Worthington et al. | |
| 3,688,460 | A | | 9/1972 | Van Loghem et al. | 62/466 |
| 3,694,983 | A | | 10/1972 | Couquet | |
| 3,731,445 | A | | 5/1973 | Hoffmann et al. | 52/391 |
| 3,823,525 | A | | 7/1974 | Bruun | |
| 3,859,000 | A | | 1/1975 | Webster | |
| 3,889,320 | A | | 6/1975 | Koscik | 24/73 |
| 3,947,614 | A | | 3/1976 | Becker | |
| 3,967,581 | A | | 7/1976 | Zirbel | |
| 3,988,187 | A | | 10/1976 | Witt et al. | 156/71 |
| 4,067,155 | A | | 1/1978 | Ruff et al. | 52/105 |
| 4,069,731 | A | | 1/1978 | Stang | 85/72 |
| 4,070,845 | A | | 1/1978 | Cody | 52/632 |
| 4,070,987 | A | | 1/1978 | Gross et al. | |
| 4,074,655 | A | | 2/1978 | Gross et al. | |
| 4,104,840 | A | | 8/1978 | Heintz et al. | 52/309.9 |
| 4,125,984 | A | | 11/1978 | Jonas | |
| 4,135,339 | A | | 1/1979 | Pawlitschek | |
| 4,169,688 | A | | 10/1979 | Toshio | |
| 4,226,064 | A | | 10/1980 | Kraayenhof | |
| 4,226,662 | A | | 10/1980 | McCort | |
| 4,296,582 | A | | 10/1981 | Simpson et al. | |
| 4,333,417 | A | | 6/1982 | Camp et al. | |
| 4,385,850 | A | | 5/1983 | Bobath | |
| 4,405,272 | A | | 9/1983 | Wollar | |
| 4,407,618 | A | | 10/1983 | Kimura | 411/40 |
| 4,426,820 | A | | 1/1984 | Terbrack et al. | |
| 4,449,346 | A | | 5/1984 | Tremblay | |
| 4,461,131 | A | | 7/1984 | Presell | |
| 4,577,448 | A | | 3/1986 | Howorth | |
| 4,599,842 | A | | 7/1986 | Counihan | |
| 4,648,231 | A | | 3/1987 | Laroche | |
| 4,653,138 | A | | 3/1987 | Carder | |
| 4,683,693 | A | * | 8/1987 | Rockar et al. | 52/198 |
| 4,741,136 | A | | 5/1988 | Thompson | 52/302 |
| 4,769,963 | A | | 9/1988 | Meyerson | |
| 4,796,402 | A | | 1/1989 | Pajala | |
| 4,808,451 | A | * | 2/1989 | McCue et al. | 428/31 |
| 4,811,542 | A | | 3/1989 | Jewell | 52/741 |
| 4,841,907 | A | | 6/1989 | Otsuka | |
| 4,845,907 | A | | 7/1989 | Meek | |
| 4,857,367 | A | | 8/1989 | Thorn et al. | |
| 4,905,442 | A | | 3/1990 | Daniels | |
| 4,911,971 | A | | 3/1990 | McCue et al. | 428/99 |
| 4,917,532 | A | | 4/1990 | Haberhauer et al. | |
| 4,953,339 | A | | 9/1990 | Jewell | 52/729 |
| 5,022,200 | A | | 6/1991 | Wilson et al. | |
| 5,042,214 | A | * | 8/1991 | Howard | 52/507 |
| 5,085,891 | A | | 2/1992 | Evans | |
| 5,086,599 | A | | 2/1992 | Meyerson | |
| 5,157,890 | A | | 10/1992 | Jines | |
| 5,179,812 | A | | 1/1993 | Hill | |
| 5,182,891 | A | | 2/1993 | Slocum | 52/480 |
| 5,182,892 | A | | 2/1993 | Chase | |
| 5,274,979 | A | | 1/1994 | Tsai | |
| 5,295,341 | A | | 3/1994 | Kajiwara | |
| 5,298,072 | A | | 3/1994 | Schiele et al. | |
| 5,332,075 | A | | 7/1994 | Quigley et al. | |
| 5,348,778 | A | | 9/1994 | Knipp et al. | |
| 5,349,796 | A | | 9/1994 | Meyerson | |
| 5,497,589 | A | | 3/1996 | Porter | |
| 5,502,939 | A | | 4/1996 | Zadok et al. | 52/309.9 |
| 5,618,602 | A | | 4/1997 | Nelson | 428/60 |
| 5,622,012 | A | | 4/1997 | Schijf | |
| 5,641,255 | A | | 6/1997 | Tanka | 411/48 |
| 5,660,016 | A | | 8/1997 | Erwin et al. | 52/483.1 |
| 5,706,621 | A | | 1/1998 | Pervan | |
| 5,706,623 | A | | 1/1998 | Brown | 52/718.04 |
| 5,736,227 | A | | 4/1998 | Sweet et al. | |
| 5,744,220 | A | | 4/1998 | Ringo | |
| 5,768,850 | A | | 6/1998 | Chen | |
| 5,772,762 | A | | 6/1998 | Hanitzsch | |
| 5,797,237 | A | | 8/1998 | Finkell, Jr. | 52/589 |
| 5,860,266 | A | | 1/1999 | Martinet | |
| 5,860,267 | A | | 1/1999 | Pervan | 52/748 |
| D406,360 | S | | 3/1999 | Finkell, Jr. | D25/138 |
| 5,882,409 | A | | 3/1999 | Stahl | |
| 5,950,389 | A | | 9/1999 | Porter | 52/586.1 |
| 5,989,668 | A | | 11/1999 | Nelson et al. | |
| 6,006,486 | A | | 12/1999 | Moriau et al. | |
| 6,023,907 | A | | 2/2000 | Pervan | |
| 6,029,416 | A | | 2/2000 | Andersson | 52/592.1 |
| 6,089,805 | A | | 7/2000 | Salmon | 411/45 |
| 6,094,882 | A | | 8/2000 | Pervan | |
| 6,101,778 | A | | 8/2000 | Martensson | |
| 6,134,854 | A | | 10/2000 | Stanchfield | |
| 6,138,435 | A | | 10/2000 | Kocher et al. | |
| 6,139,945 | A | | 10/2000 | Krejchi et al. | |
| 6,182,410 | B1 | | 2/2001 | Pervan | |
| 6,205,639 | B1 | | 3/2001 | Pervan | |
| 6,209,278 | B1 | | 4/2001 | Tychsen | 52/592.4 |
| 6,230,385 | B1 | * | 5/2001 | Nelson | 29/450 |
| 6,247,285 | B1 | | 6/2001 | Moebus | 52/589.1 |
| 6,324,803 | B1 | | 12/2001 | Pervan | 52/403.1 |
| 6,324,809 | B1 | | 12/2001 | Nelson | 52/592.2 |
| 6,325,884 | B1 | | 12/2001 | Karam | |
| 6,332,733 | B1 | | 12/2001 | Hamberger et al. | 403/329 |
| 6,339,908 | B1 | | 1/2002 | Chuang | |
| 6,345,481 | B1 | | 2/2002 | Nelson | 52/592.2 |
| 6,363,677 | B1 | | 4/2002 | Chen et al. | |
| 6,397,547 | B1 | | 6/2002 | Martensson | 52/582.1 |
| 6,418,683 | B1 | | 7/2002 | Martensson et al. | 52/282.1 |
| 6,421,970 | B1 | | 7/2002 | Martensson et al. | 52/282.1 |
| 6,446,405 | B1 | | 9/2002 | Pervan | 52/403.1 |
| 6,449,918 | B1 | | 9/2002 | Nelson | 52/582.1 |
| 6,460,306 | B1 | | 10/2002 | Nelson | |
| 6,465,046 | B1 | | 10/2002 | Hansson et al. | 427/256 |
| 6,516,579 | B1 | | 2/2003 | Pervan | |
| 6,546,691 | B2 | | 4/2003 | Leopolder | |
| 6,588,165 | B1 | * | 7/2003 | Wright | 52/506.05 |
| 2001/0024707 | A1 | | 9/2001 | Andersson et al. | |
| 2001/0029720 | A1 | | 10/2001 | Pervan | |
| 2001/0034991 | A1 | | 11/2001 | Martensson et al. | |
| 2002/0007608 | A1 | | 1/2002 | Pervan | |
| 2002/0007609 | A1 | | 1/2002 | Pervan | |
| 2002/0014047 | A1 | | 2/2002 | Thiers | |
| 2002/0046528 | A1 | | 4/2002 | Pervan et al. | |
| 2002/0056245 | A1 | | 5/2002 | Thiers | |

| | | | |
|---|---|---|---|
| 2002/0057942 | A1 | 5/2002 | Hamberger et al. |
| 2002/0083673 | A1 | 7/2002 | Kettler et al. |
| 2002/0095894 | A1 | 7/2002 | Pervan |
| 2002/0100242 | A1 | 8/2002 | Olofsson |
| 2002/0112433 | A1 | 8/2002 | Pervan |
| 2002/0127051 | A1 | 9/2002 | Olofsson et al. |
| 2002/0129579 | A1 | 9/2002 | Sekulla et al. |
| 2002/0152707 | A1 | 10/2002 | Martensson |

FOREIGN PATENT DOCUMENTS

| | | |
|---|---|---|
| JP | 02210148 | 8/1990 |
| JP | 04106264 | 4/1992 |
| JP | 7300979 | 11/1995 |
| JP | 2000179125 | 6/2000 |
| SE | 8202 375-5 | 4/1982 |
| WO | 00/20705 | 4/2000 |
| WO | 00/20706 | 4/2000 |
| WO | 01/09460 | 2/2001 |

* cited by examiner

LAMINATE FLOORING

RELATED APPLICATIONS

The present application is a continuation-in-part of U.S. patent application Ser. No. 09/941,500, filed Aug. 29, 2001 now abandoned, and entitled "Interconnecting Disengageable Flooring System", and which is a divisional of U.S. patent application Ser. No. 09/436,317, filed Nov. 8, 1999, and entitled "Interconnecting Disengageable Flooring System", which is currently U.S. Pat. No. 6,460,306. The present application is also a continuation-in-part of U.S. patent application Ser. No. 10/265,900, filed Oct. 7, 2002 now U.S. Pat. No. 6,769,217, and entitled "Interconnecting Disengageable Flooring System", and which is a continuation of U.S. patent application Ser. No. 09/436,317, filed Nov. 8, 1999, and entitled "Interconnecting Disengageable Flooring System", which is currently U.S. Pat. No. 6,460,306.

BACKGROUND OF THE INVENTION

1. Field of the Invention

The invention relates to decorative laminate flooring panels. More particularly, the invention relates to a connection system for decorative laminate flooring panels wherein the end seams and side seams of adjacent panels are connected in different manners such that the end seam connectors may be engineered differently from side seam connectors to provide for the different features of the side seams and end seams. In addition, the invention relates to a connector utilized in connecting decorative laminate flooring panels.

2. Description of the Prior Art

Decorative laminates have found widespread use as their ability to replicate natural materials has improved over the years. For example, decorative laminates are commonly used as replacements for natural materials in the construction of flooring, furniture, cabinets, and countertops. In each of these applications, a decorative surfacing layer is bonded to a substrate, namely, plywood, particleboard, chipboard, medium density fiberboard, etc., for added structural stability. The term "corestock" is used throughout the body of the present application to generally describe the various wood-based substrates used in the fabrication of decorative laminate panels.

In particular, decorative laminates have found widespread use in flooring products as a replacement for traditional hardwood floors. Early decorative laminate flooring systems relied upon traditional tongue and groove connections held together through the application of adhesive within the joint linking adjacent flooring panels. Although these tongue and groove glue connections provided a sound flooring surface, the use of glue for bonding adjacent flooring panels made the installation of laminate flooring systems time consuming and messy.

Recent developments in laminate flooring systems have lead to the introduction of "glueless" flooring systems. These flooring systems rely upon various mechanical coupling profiles for connecting adjacent flooring panels without the need for the time and mess associated with previous glue based systems.

However, these glueless flooring systems also have shortcomings. For example, many of these systems, while providing a secure connection between adjacent flooring panels, do not permit the ready separation of flooring panels in the event it is necessary to remove all or a portion of the flooring surface in the event damage to the flooring surface necessitates the replacement of the flooring surface. In addition, many connection systems require that the flooring panels be positioned in awkward configurations during the installation process, making it time consuming and highly difficult to complete installation when the flooring panels are installed in tight or irregular spaces.

In addition to the problems associated with the installation of decorative laminate flooring systems, those skilled in the art will appreciate the various problems encountered even after the flooring panels are properly installed. One common problem is disengagement of constrained flooring panels along the end seam (i.e., the seam along the short edge of a rectangular flooring panel). This is caused when downward pressure along the end seams of the flooring panels causes the flooring panels to shift in a manner that detrimentally affects the holding power of the mechanical connection. It is believed the propensity for disengagement along the end seams is a result of the fact that the ends seams are substantially shorter than the side seams, and consequently offer less surface area for the creation of very strong mechanical connections. The limited holding strength becomes apparent when the flooring panels shift under the pressures associated with normal usage, for example, downward application of force along the end seams, lateral force generated by shifting flooring panels, lateral force generated by the expansion and contraction of the flooring panels, etc. Since the vast majority of flooring systems rely upon the same type of mechanical connection along both the end seam and the side seam, the limited strength of the mechanical connections along the end seam are not commonly compensated for when the flooring panels are installed upon a support surface.

With the foregoing in mind, current decorative laminate flooring systems exhibit a variety of shortcomings and the present invention overcomes these shortcomings by providing a unique connection structure which accommodates the need for additional holding power along the end seams of flooring panels.

SUMMARY OF THE INVENTION

It is, therefore, an object of the present invention to provide a disengageable connector for interconnecting panels. The connector includes a longitudinally extending connector body having a base and a projection extending from the base. The base includes a top surface and a bottom surface, and at least one footing member extending downwardly from the bottom surface of the base. The footing member is shaped and dimensioned to compress the upper surface of a resilient pad positioned beneath the connector and the panels.

It is also an object of the present invention to provide an interlocking flooring system. The flooring system includes a plurality of flooring panels, each flooring panel including a plurality of edges. A first connecting member is provided for connecting adjacent flooring panels and a second connecting member is provided for connecting adjacent flooring panels. The first connecting member is different from the second connecting member and provides greater resistance to disengagement of adjacent flooring panels when compared to the second connecting member. The flooring system further includes a resilient pad positioned beneath the flooring panels.

It is another object of the present invention to provide a disengageable connector for interconnecting panels. The connector includes a longitudinally extending connector body having a base with a longitudinal extent. The connector further includes a projection extending vertically from a top surface of the base. The projection extends beyond the longitudinal extent of the base along at least one end of the base to define an outwardly extending ear.

It is a further object of the present invention to provide an interlocking flooring system. The flooring system includes a plurality of flooring panels. Each flooring panel includes first and second long edges and first and second short edges. Each flooring panel also includes first and second grooves in an underside of the flooring panel respectively adjacent the first and second short edges. The first and second long edges respectively include integral connecting members shaped and dimensioned such that the connecting member of the first long edge will engage the connecting member of the second long edge of an adjacent flooring panel. A distinct connector is also provided. The connector is shaped and dimensioned for coupling the first or second short edges of adjacent flooring panels. The connector includes a longitudinally extending connector body having a base and a projection extending from the base. The base includes a top surface and a bottom surface. The base further includes two protrusions extending vertically from the top surface. The protrusions are spaced apart from the projection and are located on either side of the projection in a position to grip the first and second grooves formed along the underside of the flooring panels.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 1*a* is a detailed perspective view of the flooring panel shown in FIG. 1.

FIG. 2*a* is a detailed perspective view of the flooring panel shown in FIG. 2.

FIG. 19*a* is a detailed perspective view of the flooring panel shown in FIG. 19.

FIG. 20*a* is a detailed perspective view of the flooring panel shown in FIG. 20.

DESCRIPTION OF THE PREFERRED EMBODIMENTS

Figure 1:
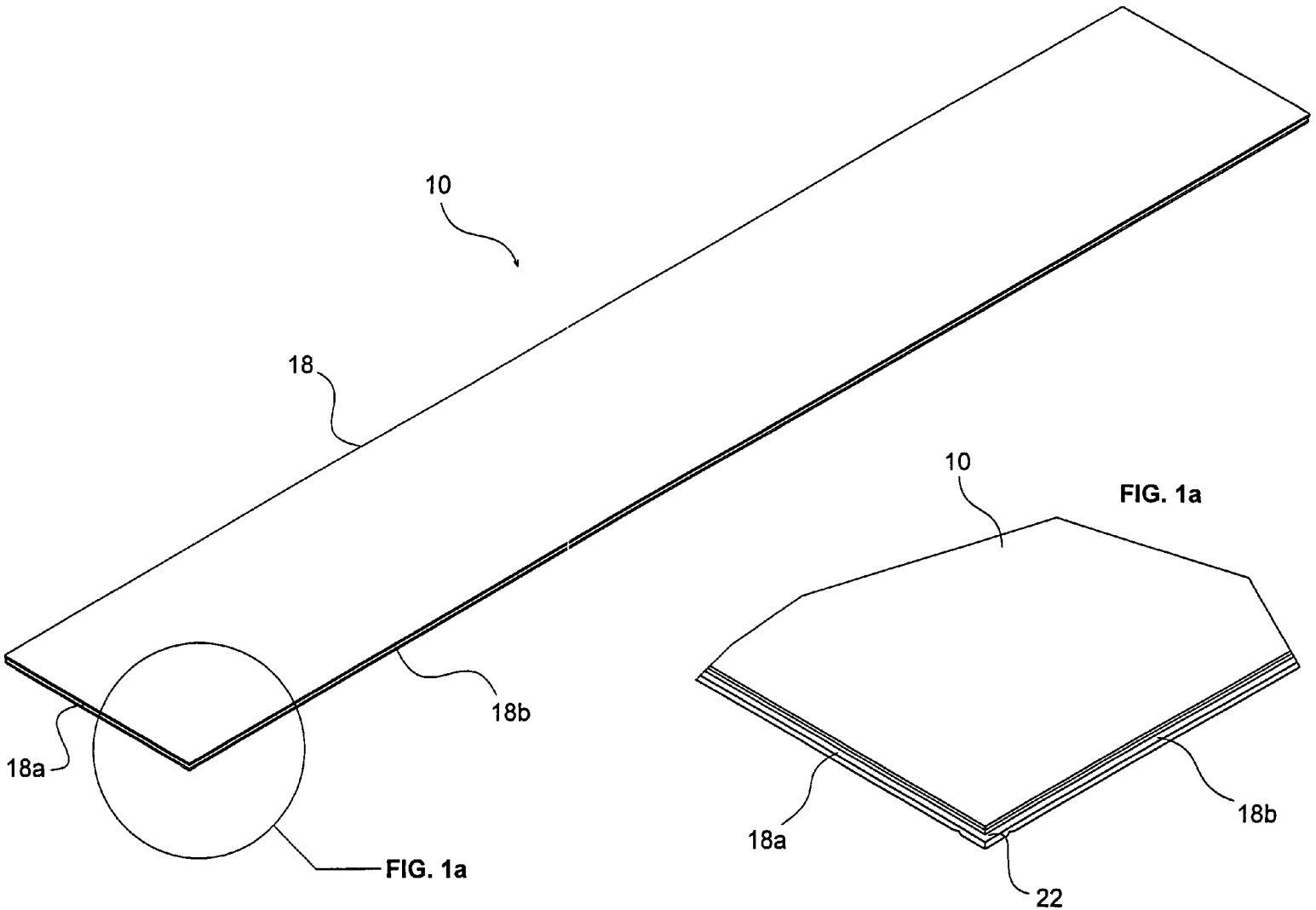
FIG. 1 is a top perspective view of a flooring panel in accordance with a preferred embodiment of the present invention.
Figure 2:
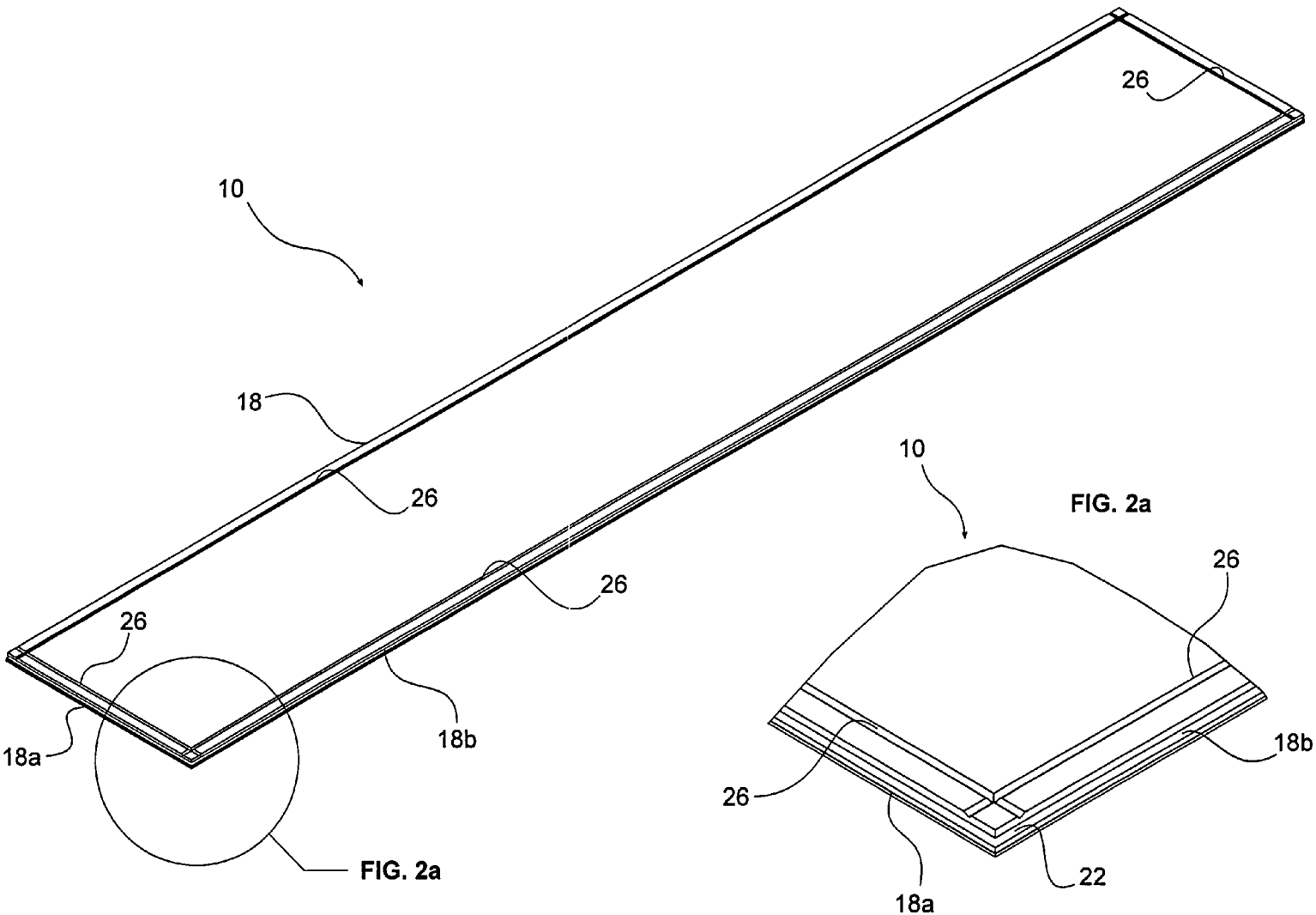
FIG. 2 is a bottom perspective view of the flooring panel shown in FIG. 1.
Figure 3:
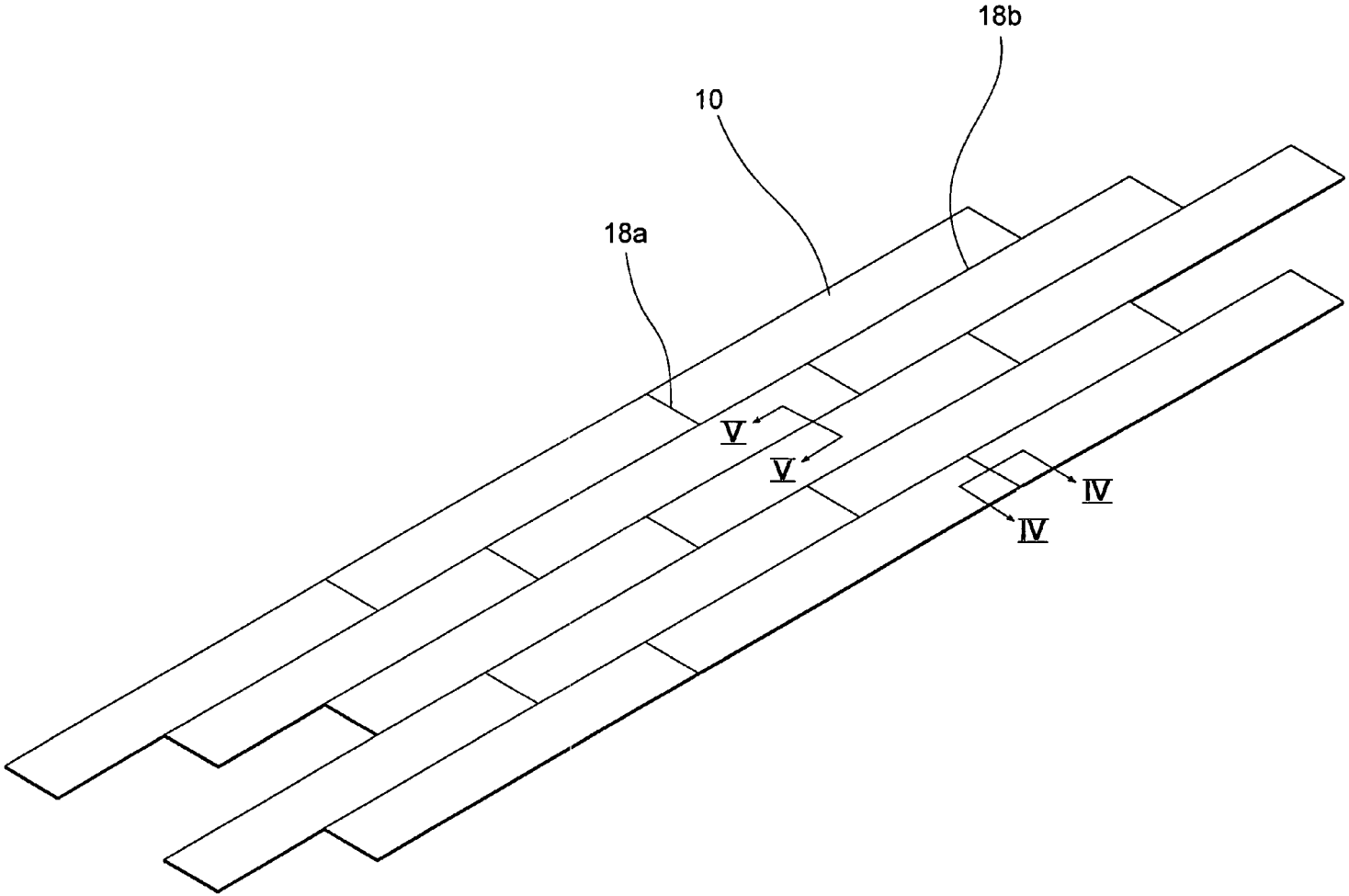
FIG. 3 is a top perspective view of assembled flooring panels in accordance with a preferred embodiment of the present invention.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

With reference to FIGS. 1, 1*a*, 2, 2*a*, 3, 4 and 5, a decorative laminate flooring panel 10 used in conjunction with present connection system is disclosed. The decorative laminate flooring panel 10 generally includes a decorative surfacing layer 12 (or decorative laminate), a backing layer 14 and a substrate 16, more particularly, corestock positioned between the decorative surfacing layer 12 and the backing layer 14. The edge 18 of the flooring panel 10 includes an outwardly facing, interlocking profile 20 shaped and dimensioned for selective attachment to adjacent laminate flooring panels in accordance with the present invention.

While the present invention is disclosed with reference to the use of decorative laminate flooring panels, it is contemplated the concepts underlying the present invention may be employed in conjunction with traditional hardwood floors and other surfacing structures without departing from the spirit of the present invention. In addition, the concepts of the present invention may be applied to interlocking panels other than flooring panels without departing from the spirit of the present invention.

In accordance with a preferred embodiment of the present invention, the decorative surfacing layer 12 is a conventional surfacing layer commonly used in the fabrication of flooring panels. The decorative surfacing layer 12 includes an overlay paper layer, a decorative sheet and a core layer. The overlay paper layer is preferably a melamine resin impregnated paper layer. The decorative sheet is a conventional pattern sheet positioned directly beneath the overlay paper layer and the core layer is phenolic resin impregnated kraft paper positioned beneath the decorative sheet. When the decorative laminate is fully heated and pressed, the overlay paper layer becomes translucent, fully exposing the decorative sheet. With this in mind, the decorative sheet is substantially responsible for the aesthetic appearance of the finished decorative laminate.

Although high pressure decorative laminates are preferred for use in accordance with the present invention, low pressure, direct pressure or continuous decorative laminates may be used without departing from the spirit of the present invention.

With regard to the backing layer 14, it is commonly composed of melamine-impregnated paper and one, or more, layers of phenolic resin impregnated kraft paper. While a standard backing layer is disclosed in accordance with a preferred embodiment of the present invention, the backing layer may take various forms known to those skilled in the art without departing from the spirit of the present invention. As with the decorative surfacing layer 12, the three sheets making up the backing layer 14 are stacked, heated and pressed to cure and consolidate the sheets, thereby forming a unitary sheet which may be used as a backing layer 14 in accordance with the present invention.

Finally, the substrate 16 is a conventional wood-based substrate commonly used in the manufacture of decorative laminate panels. With this in mind, the substrate 16 is preferably formed of plywood, particleboard, chipboard, medium density fiberboard, high density fiberboard, woods, filled plastics, unfilled plastics, ceramics, fibers, polymeric foams, and combinations thereof, although other materials may be used without departing from the spirit of the present invention.

The decorative surfacing layer 12 and the backing layer 14 are adhesively bound to respective first and second sides of the substrate 16 to form a raw decorative laminate panel. However, recent advances in decorative laminate flooring panels dictate that the edge profile of the decorative laminate panel be shaped and dimensioned for selective interlocking with adjacent panels. As such, the edges 18 of the substrate 16 are machined to produce a flooring panel 10 with a desired edge profile 20.

With reference to FIGS. 1*a*, 2*a*, 4 and 5, the edge profile 20 of panels 10 formed in accordance with a preferred embodiment of the present invention is the same about the entire perimeter of the flooring panel 10 in order to take advantage of the present track locking system. That is, each edge 18 of the panels 10 formed in accordance with the present invention is formed with an identical dado 22 so as to be compatible with the track locking strips 24, 124 employed in accordance with a preferred embodiment of the present invention. The use of identical edge profiles provides for versatility in the installation of such flooring panels.

In addition, grooves 26 shaped and dimensioned for the receipt of a track locking strip 24, 124 are formed in the bottom surface 28 of the flooring panel 10 for installation in a manner which will be discussed below in greater detail. In addition to assisting in the connection of adjacent flooring panels 10, the grooves 26 separate the majority of the backing layer 14 from the edges 18 of the flooring panels 10 to thereby minimize the effects of expansion and contraction when the backing layer 14 is exposed to varying environmental conditions.

As discussed above, the present invention provides for different mechanical connections along the short side 18*a* and long side 18*b* of the flooring panel 10. In accordance with a preferred embodiment of the invention, different track locking strips are employed along the short and long sides 18*a*, 18*b* of the flooring panels 10. The short track locking strip 24 is disclosed with reference to FIGS. 6 to 9, while the long track locking strip 124 is disclosed with reference to FIGS. 10 to 13. As the following disclosure will reveal, the short track locking strip 24 and the long track locking strip 124 are very similar, although the short track locking strip 24 includes various features specifically designed for the constrained characteristics encountered along the end seam (that is, the connection point of adjacent flooring panels 10 along their respective short sides 18*a*) of adjacent flooring panels 10.

The terms "vertical" and "horizontal" are used below to describe the present invention as it might be used in the installation of a flooring system where the panels are placed upon a horizontal support surface. However, those skilled in the art will readily appreciate that the present invention may be used in other applications beyond flooring systems. As such, the relative terms "horizontal" and "vertical" are used merely as explanatory terms and should not be considered to limit the scope of the present invention.

In accordance with a preferred embodiment of the present invention, both the short and long track locking strips 24, 124 are formed of extruded aluminum. However, and as will be discussed below in greater detail, it is contemplated that the track locking strips may be manufactured from materials selected from the group consisting of filled and unfilled plastics, elastomers, wood composites, ceramics, metals, foamed plastics and combinations thereof. Depending upon the material and size, the track locking strips may be manufactured using a variety of techniques known in the art.

Figure 4:
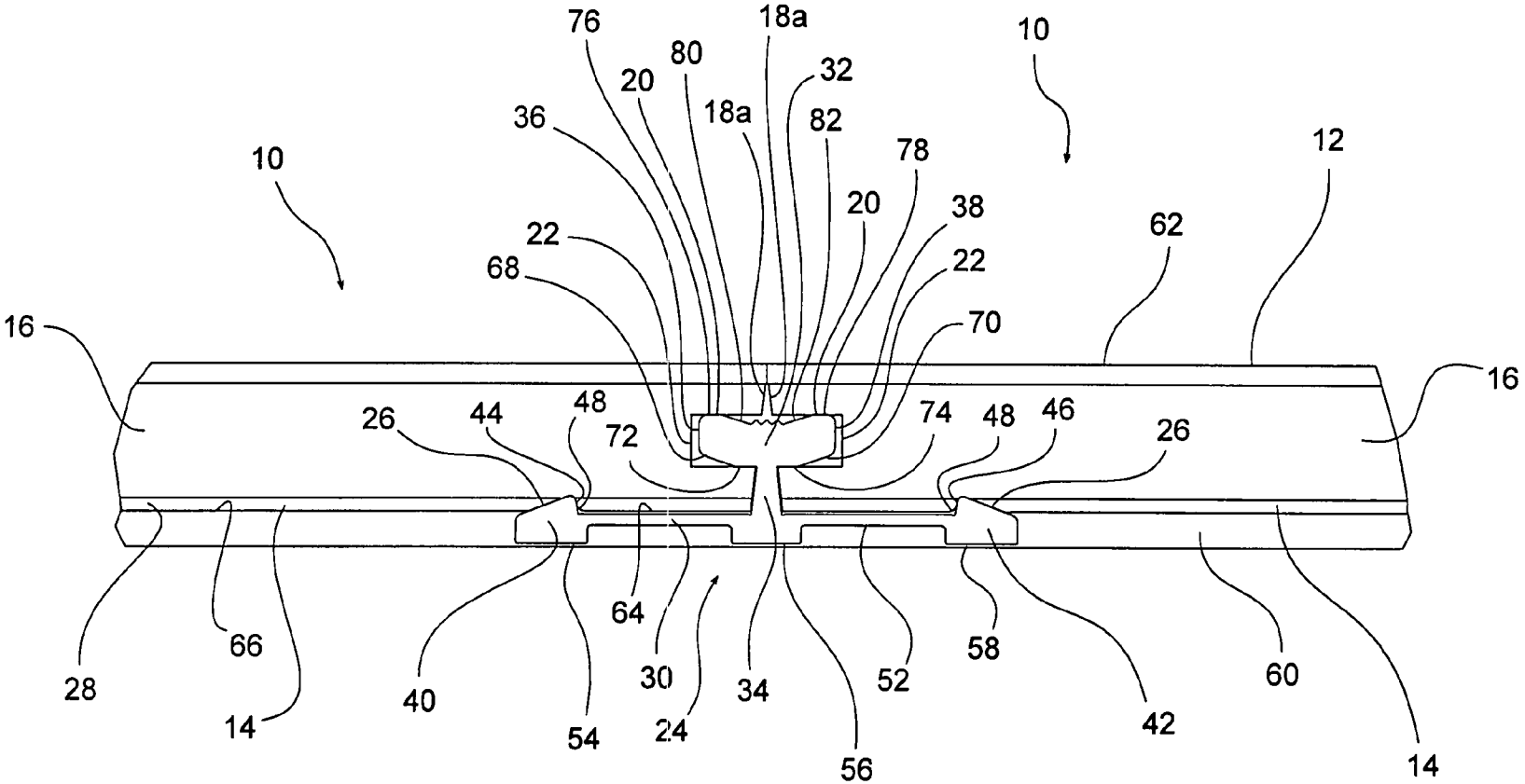
FIG. 4 is a cross sectional view of an end seam along the line IV-IV in FIG. 3.

Briefly, and with reference to FIGS. 6 to 9, a preferred embodiment of a short track locking strip 24 in accordance with the present invention is disclosed. The short track locking strip 24 maintains the same profile along its entire length. The short track locking strip 24 includes a base 30, a projection 32 having a central stem 34 with identical first and second outwardly extending members 36, 38 extending therefrom, and first and second protrusions 40, 42 spaced apart from, and on either side of, the projection 32 projecting upwardly from base 30. The first and second protrusions 40, 42 are preferably rounded on the top portion as shown, and taper away, i.e., decrease in height, as they move away from the center of the base 30 toward the edge of the base 30. Thus, the portion of the first and second protrusions 40, 42 closest to the center of the base 30, and the projection 32, extend the greatest distance vertically, forming a central facing surface 44, 46 on each of the protrusions 40, 42. By forming the first and second protrusions 40, 42 with central facing surfaces 44, 46, they "grip" the grooves 26 of adjacent flooring panels 10 and prevent the adjacent flooring panels 10 from moving apart. In particular, the protrusions 40, 42 grip the backing layer 14 of the flooring panels 10 as the grooves 26 are formed through the backing layer 14. In other words, and as shown in FIG. 4, the central facing surfaces 44, 46 of the first and second protrusions 40, 42 engage the outer walls 48 of the respective grooves 26 to prevent the adjacent flooring panels 10 from moving in a direction laterally away from the track locking strip 24 to which they are bound.

The structural stability of the track locking strip 24 is enhanced by the provision of concave recesses 50 at the respective junctions between the base 30 and the projection 32, and the base 30 and the first and second protrusions 40, 42. The concave recesses 50 enhance stability by creating rounded transitions between the base 30 and the projection 32, the first protrusion 40 and the second protrusion 42. In addition, the recesses 50 serve as a relief allowing for slight variations in the track locking strip 24 which might interfere with flooring panel 10 insertion.

The base 30 includes an underside 52 with a plurality of downwardly extending footing members 54, 56, 58. The footing members 54, 56, 58 extend downwardly from positions directly beneath the first protrusion 40, the projection 32 and the second protrusion 42. Briefly, the downwardly extending footing members 54, 56, 58 allow the short track locking strip 24 to compress into a resilient, foam pad 60 commonly positioned beneath a flooring system installed in accordance with the present invention. By permitting the short track locking strip 24 to compress into a pad 60, seams between adjacent flooring panels 10 are securely held together, even when the flooring panels 10 are constrained under downward force being applied from the upper surface 62 thereof. It is contemplated that the shape of the web between the footing members 54, 56, 58 may vary without departing from the spirit of the present invention.

The inclusion of the footing members 54, 56, 58 fully compresses the track locking strip 24 into the foam pad 60 to such an extent movement of the track locking strip 24 due to downward focus is minimized in a manner which substantially prevents inadvertent disengagement. That is, the footing members 54, 56, 58 prevent "rocking" of the track locking strip 54, 56, 58 which might otherwise result in disengagement. As a result, the downward forces work in a positive manner to compress the footing members 54, 56, 58 into the foam pad 60 and stabilize the movement of the flooring panels 10.

In particular, and as will be discussed below in greater detail, it has been found that constrained floors are especially susceptible to disengagement along end seams (i.e., seams along the short side 18*a* of a flooring panel 10). The provision of footing members 54, 56, 58 in accordance with the present invention has been found to enhance the holding strength of constrained adjacent flooring panels 10 along their end seams.

Further to the previous explanation relating to the function of the footing members 54, 56, 58, the provision of downwardly extending footing members 54, 56, 58 in accordance with the present invention creates "footers" which sink into and compress the underlying foam pad 60, holding the adjacent flooring panels 10 securely in positioned despite the application of downward pressure along the seams. In addition, the downwardly extending footing members 54, 56, 58 control the depth to which the short track locking strip 24 will sink within the foam pad 60 under the pressure of weight being applied to the flooring surface. In particular, the footing members 54, 56, 58 will compress into the underlying foam pad 60 to a predetermined limited extent such that the short track locking strip 24 sits upon the underlying foam pad 60 with the upper surface 64 of the base 30 lying in substantially the same plane as the upper surface 66 of the underlying foam pad 60. In this way, the short track locking strip 24 will compress no further into the foam pad 60 upon the application of downward force, creating a controlled connecting mechanism ideally suited for connecting adjacent flooring panels 10 commonly subjected to very high and uncontrolled downward forces.

For example, and in accordance with a preferred embodiment of the present invention, a foam pad 60 is commonly approximately 0.0625 inches thick and it has been found such foam pads 60 may be compressed to a minimal thickness of approximately 0.004 inches when subjected to substantial downward pressure. As mentioned above, the short track locking strip 24 is designed to compress within the foam pad 60 to a position wherein the upper surface 64 of the base 30 is aligned with the upper surface 66 of the foam pad 60. As the base 30 is approximately 0.023 inches thick it is necessary to form the footing members 54, 56, 58 with a depth of approximately 0.036 inches.

Although specific dimensions are disclosed above for the construction of a short track locking strip in accordance with a preferred embodiment of the present invention, those skilled in the art will appreciate the fact that the dimensions may be varied depending upon the thickness and compressibility of the foam pad.

In addition, it should be understood that the depth of the footing members 54, 56, 58 is limited. If the footing members 54, 56, 58 are formed too deep, the base 30 will sit above the foam pad 60 and will, therefore, undesirably raise the surface of the flooring panels 10 along the seam. As briefly mentioned above, the short track locking strip 24 with footing members 54, 56, 58 is best applied along the end seams of adjacent flooring panels 10. The desired use of the short track locking strip 24 with footing members 54, 56, 58 results from the fact that greater downward pressure, when considering the respective lengths of the long and short sides, is encountered along the end seams of a constrained flooring panel 10. That is, the pressure necessary to compress the footing members 54, 56, 58 into the underlying foam pad 60 is generally only found along the end seams. As such, if one were to place the short track locking strip 24 with footing members 54, 56, 58 along the side seams, i.e., the long side 18*b* of the flooring panel 10, the footing members 54, 56, 58 would not properly compress the underlying foam pad 60 and the track locking strip 24 would sit up above the foam pad 60 in a highly undesirable manner.

Figure 5:
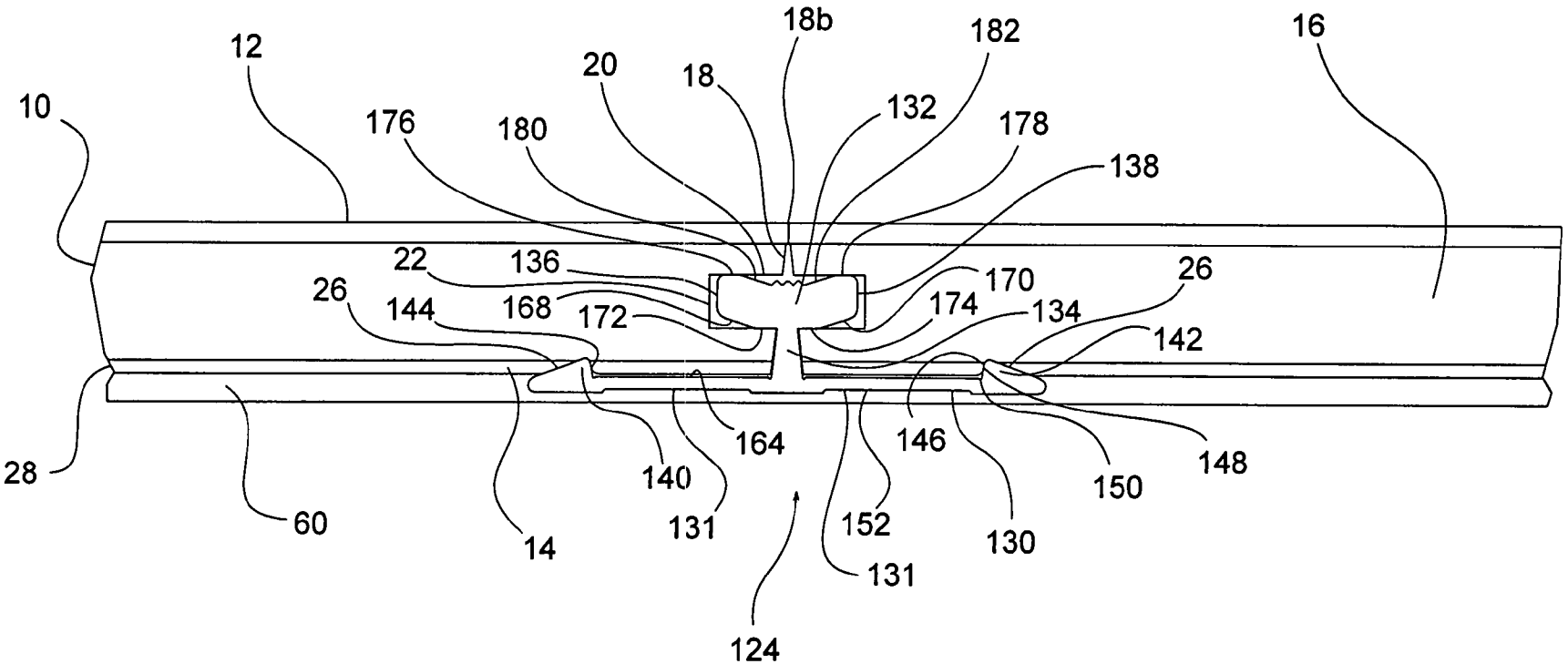
FIG. 5 is a cross sectional view of a side seam along the line V-V in FIG. 3.
Figure 6:
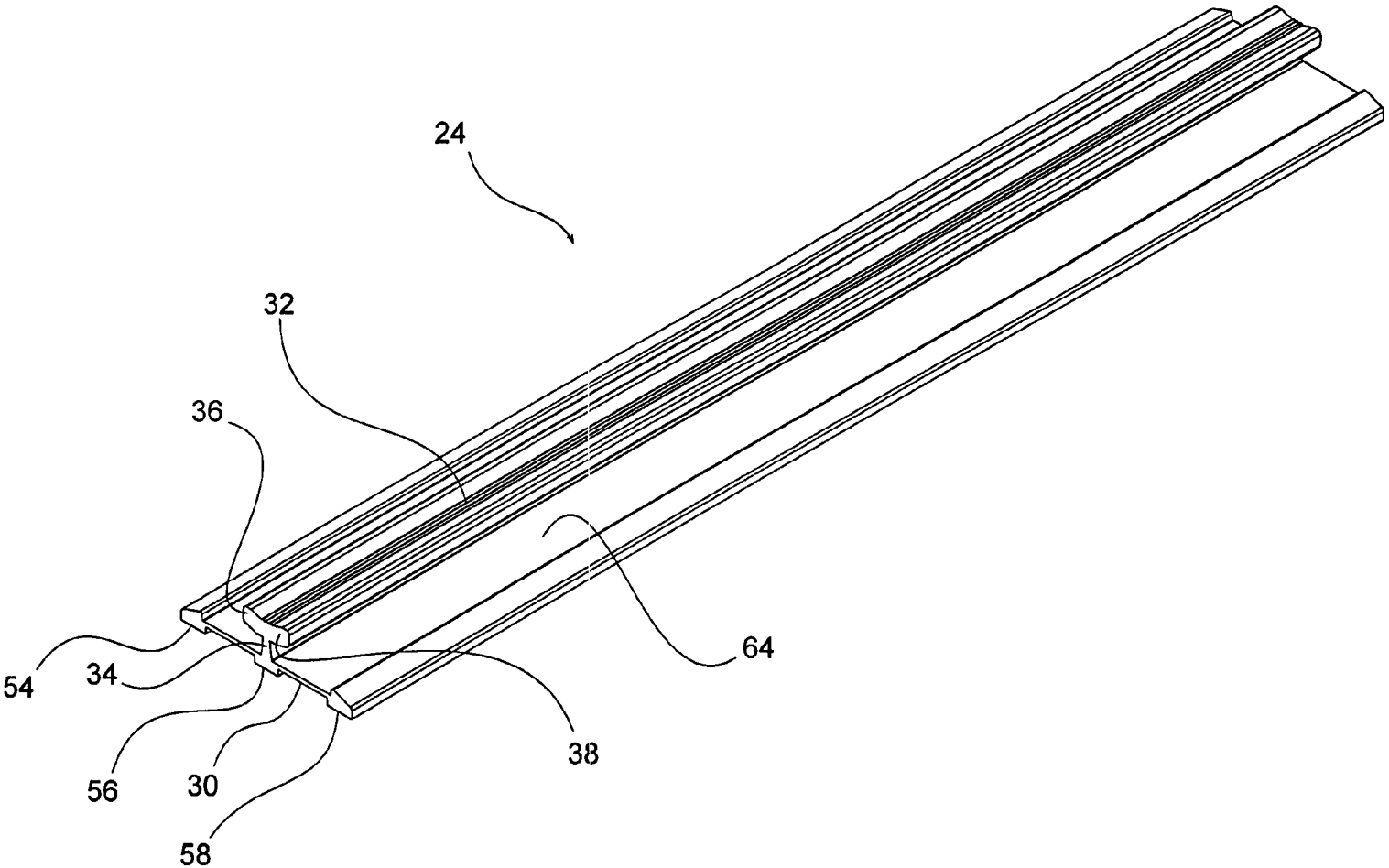
FIGS. 6-9 are various views of a short track locking strip with footing members.
Figure 7:
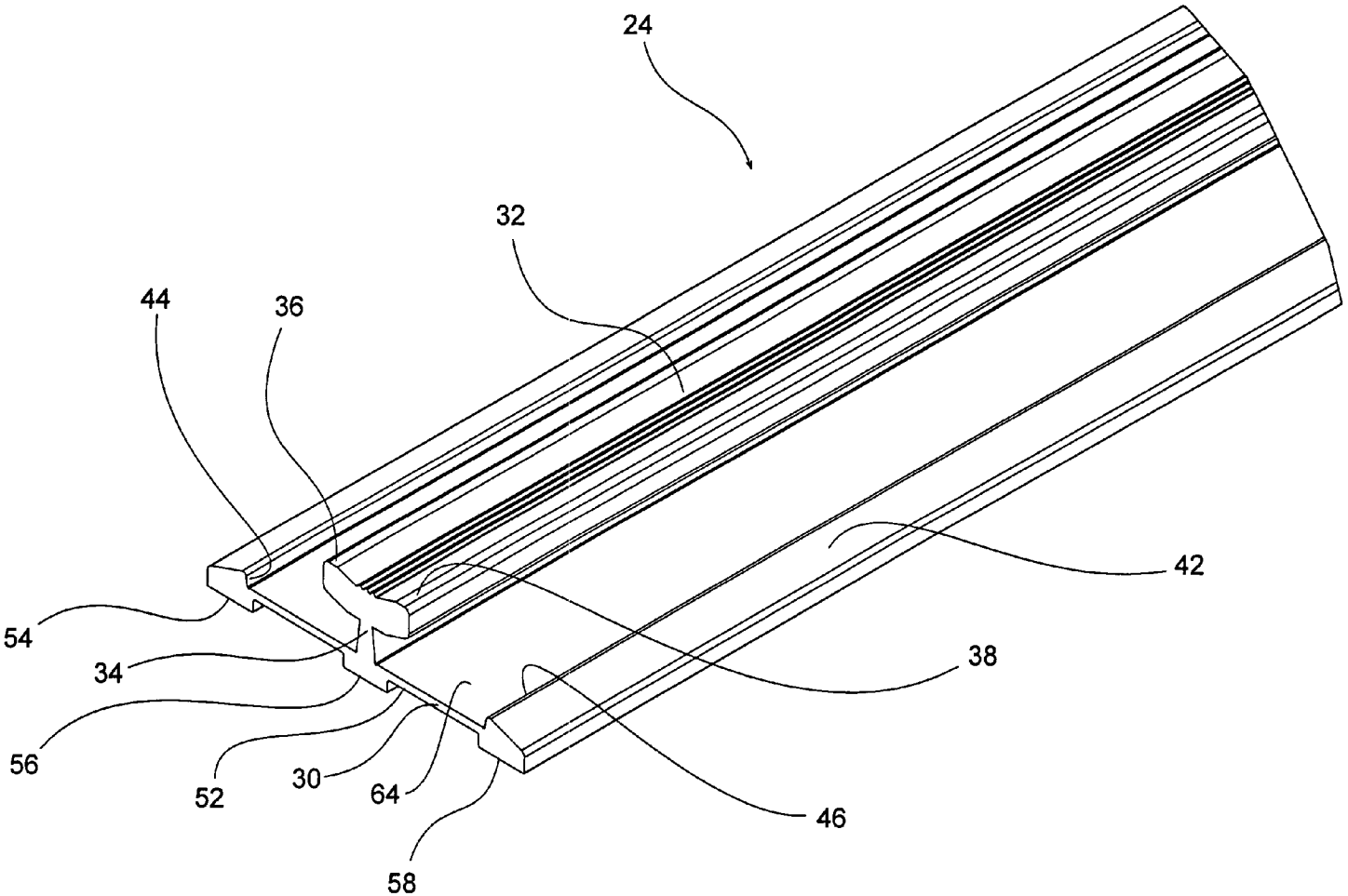
Figure 8:
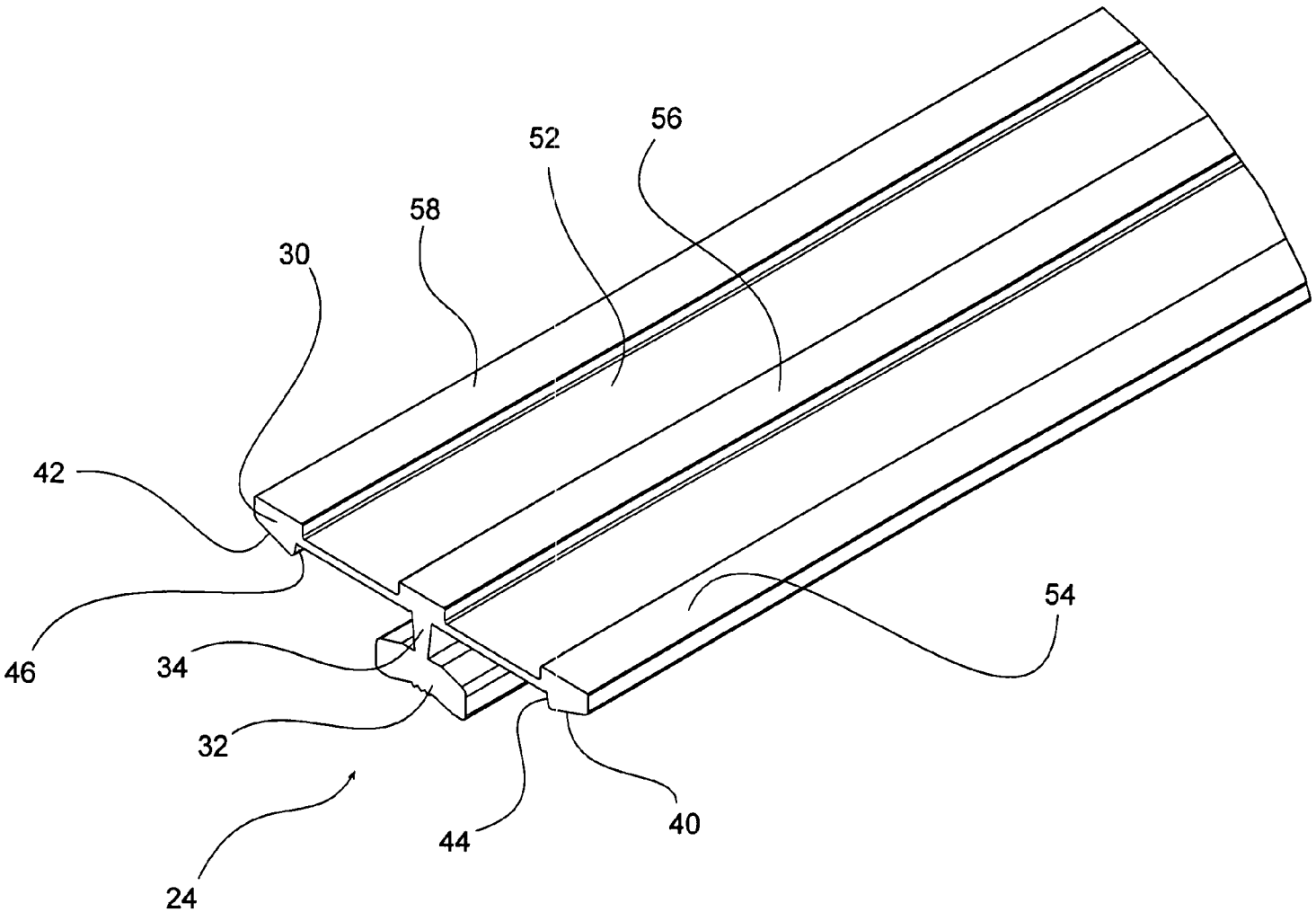
Figure 9:
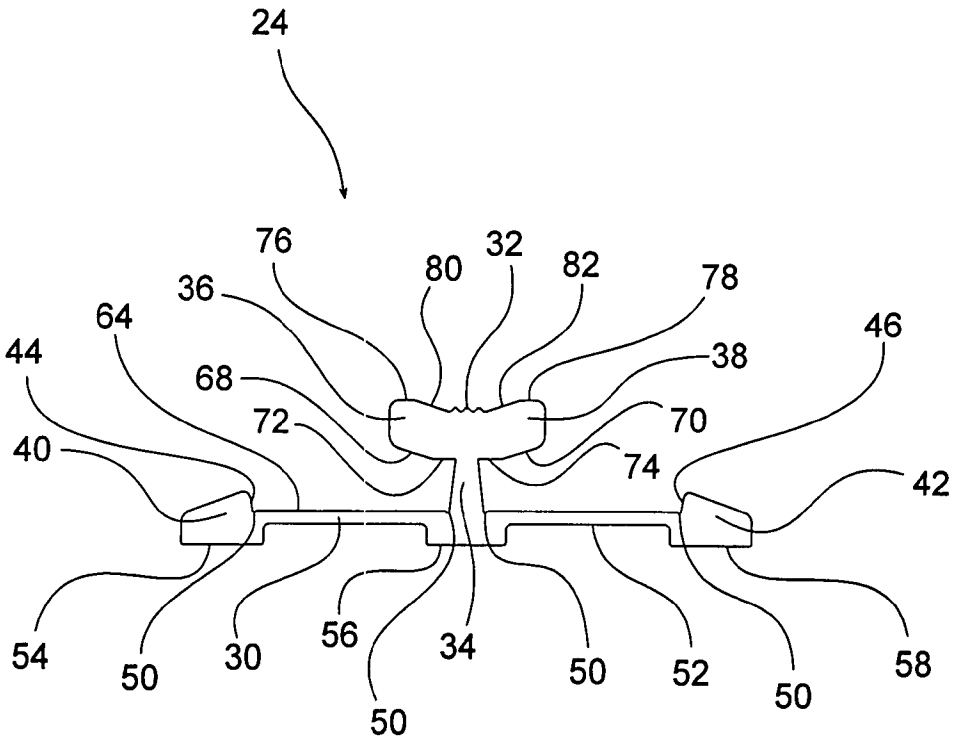
Figure 10:
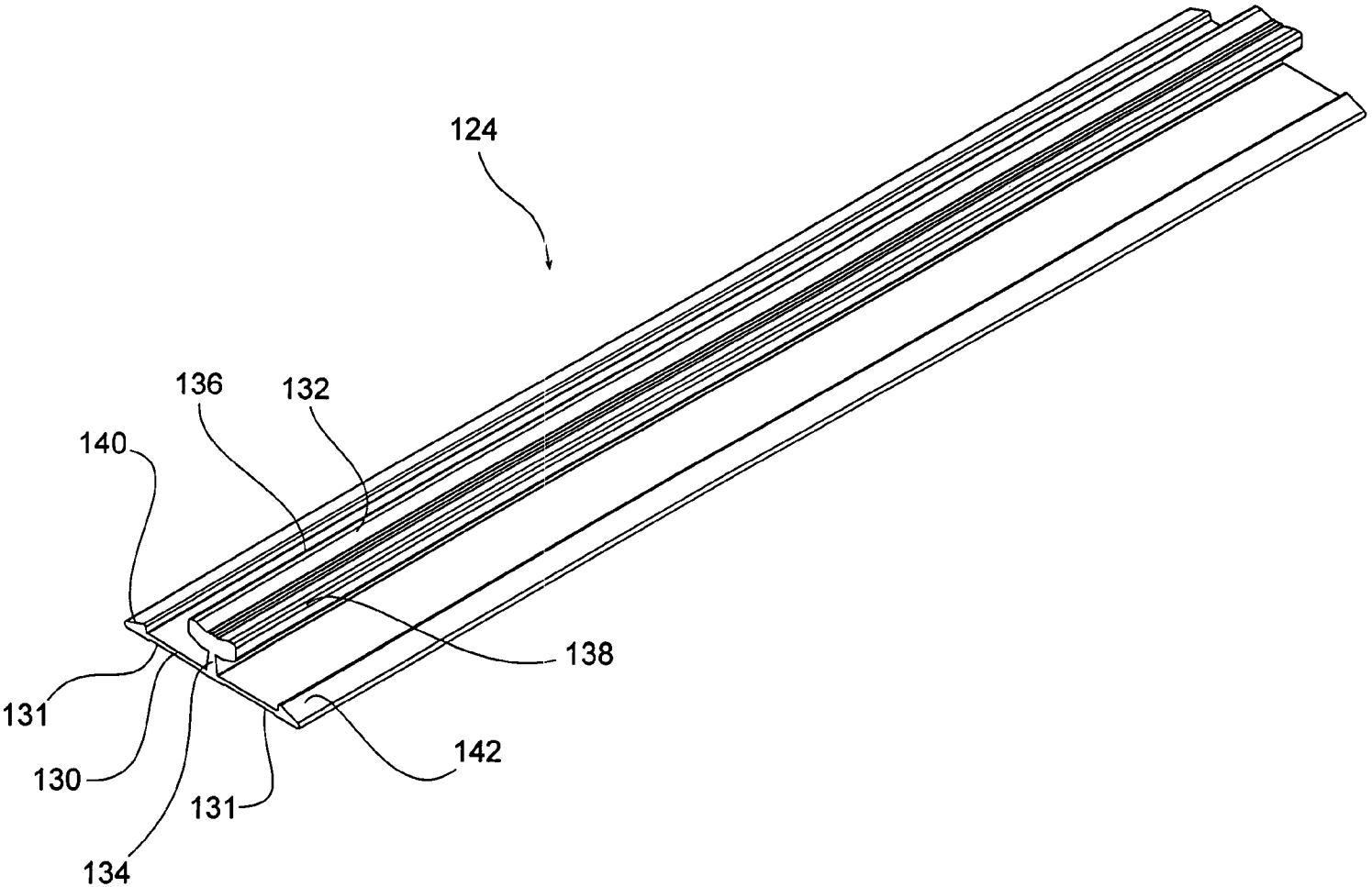
FIGS. 10-13 are various views of a long track locking strip.
Figure 11:
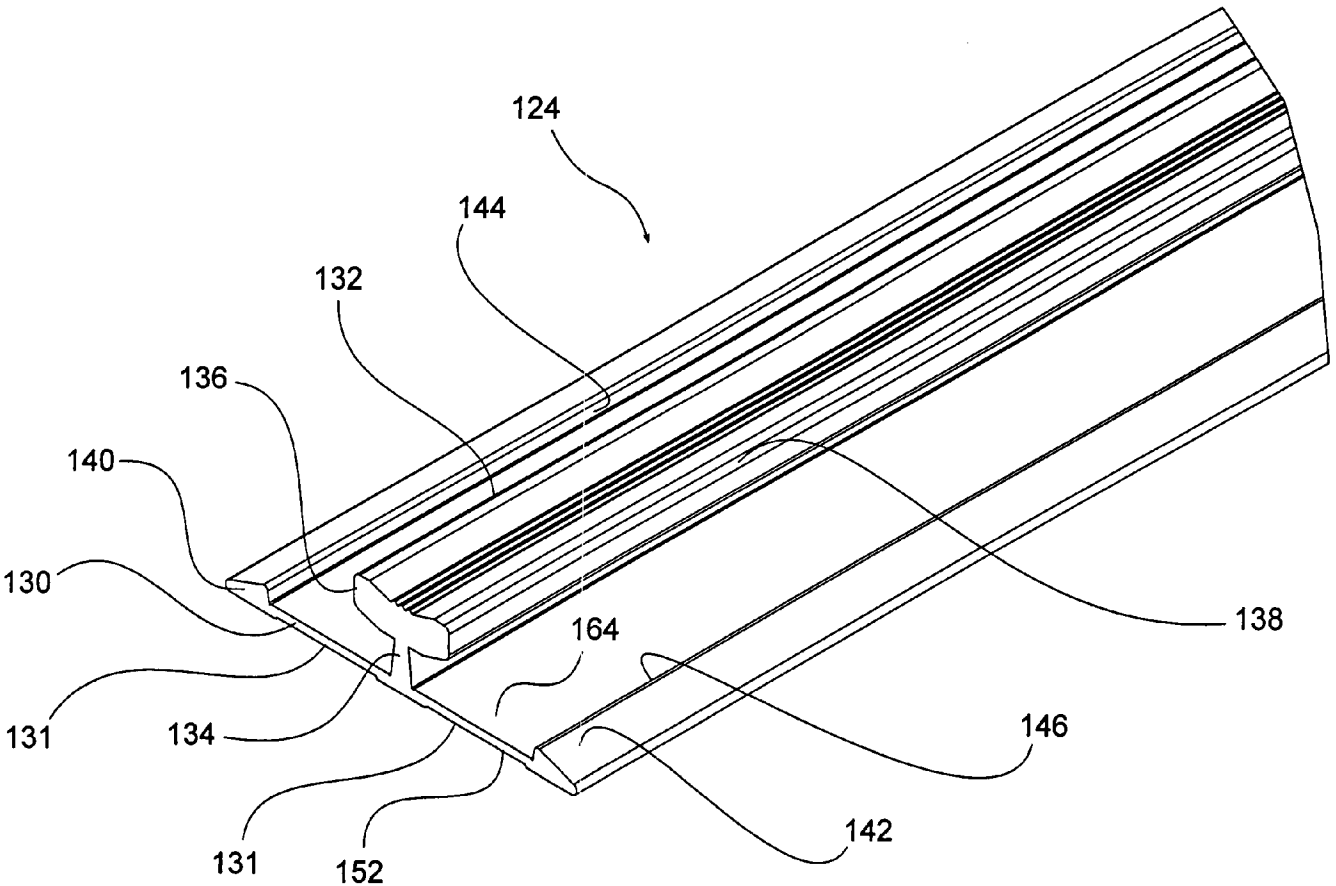
Figure 12:
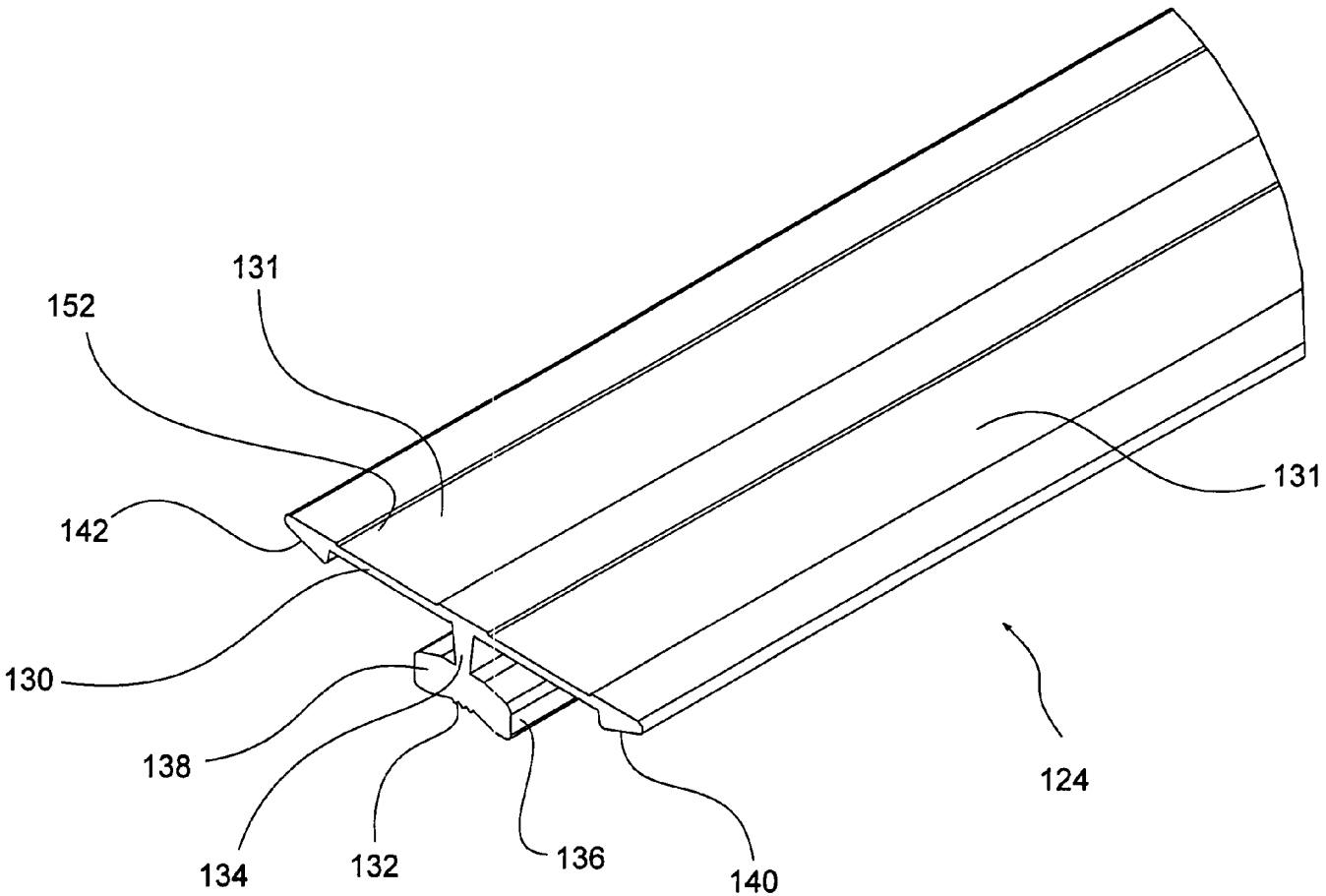
Figure 13:
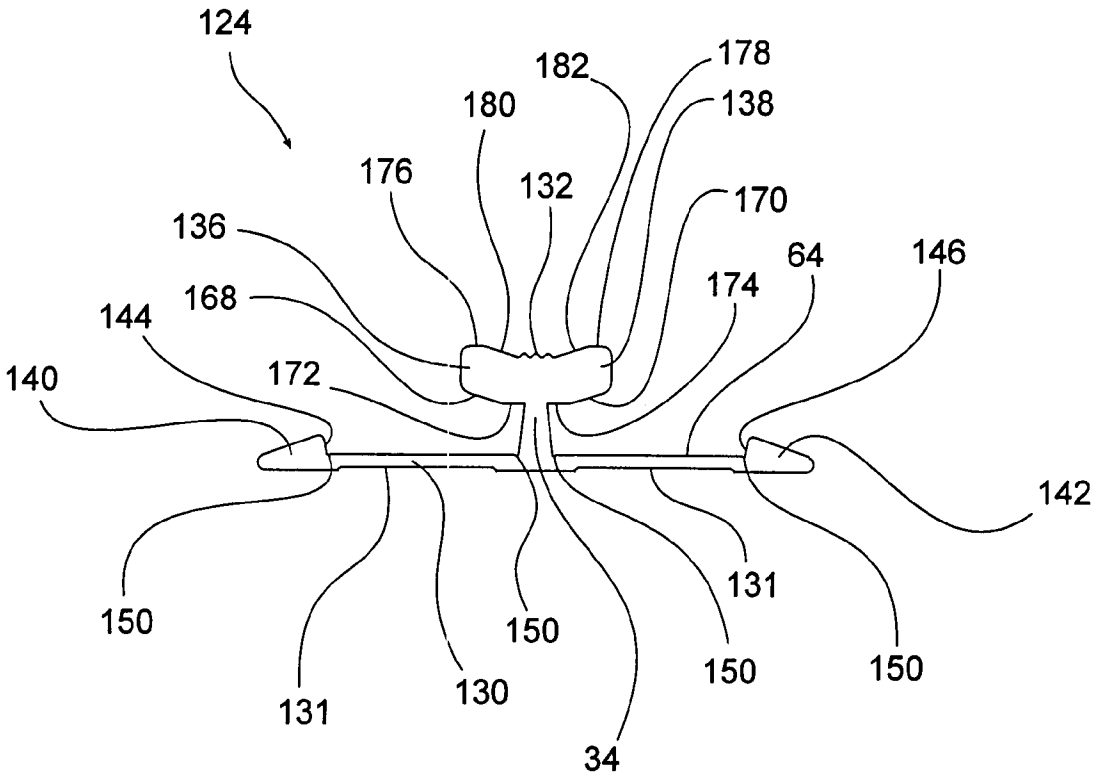
Figure 14:
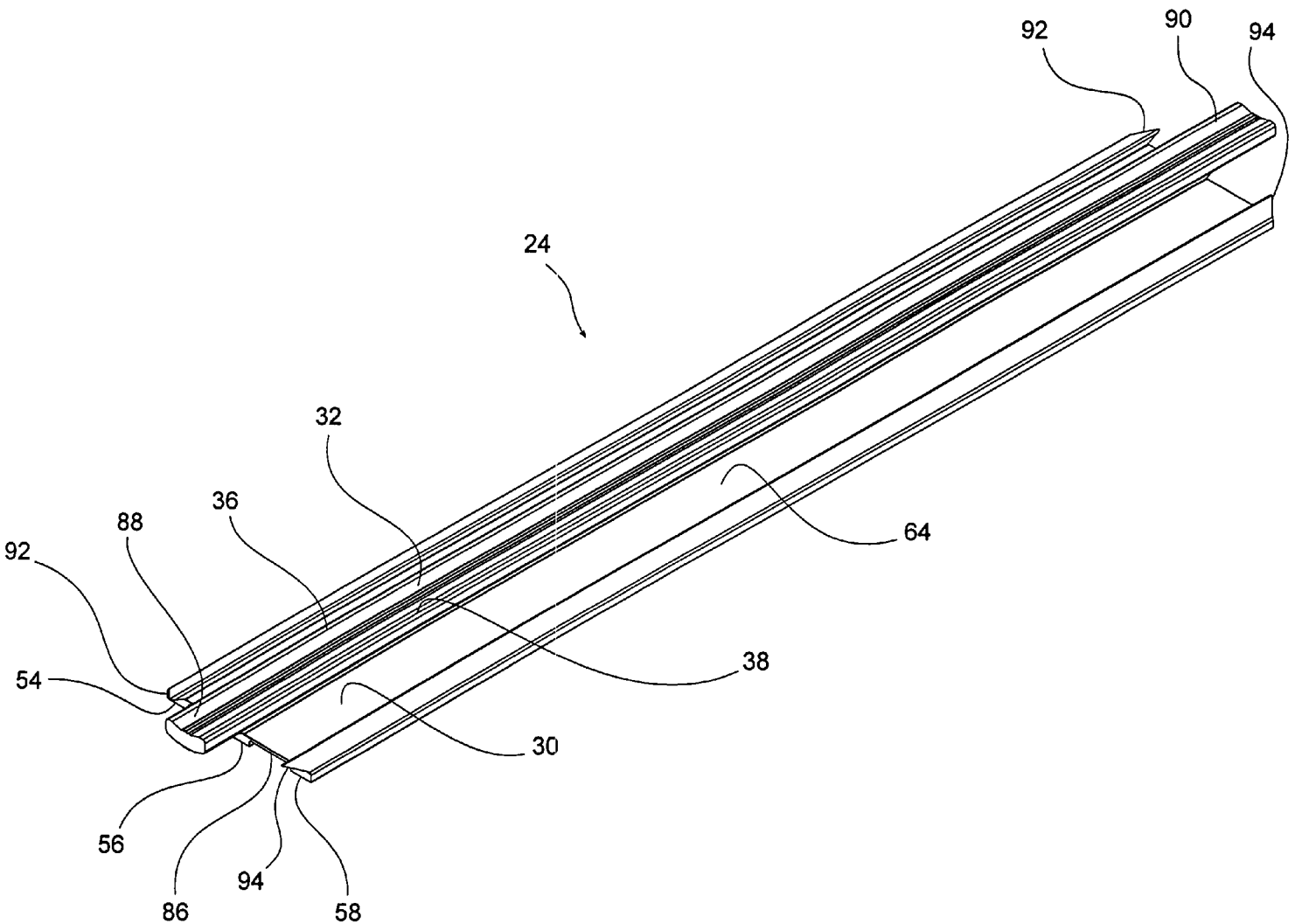
FIGS. 14-16 are various views of an injection molded short track locking strip.
Figure 15:
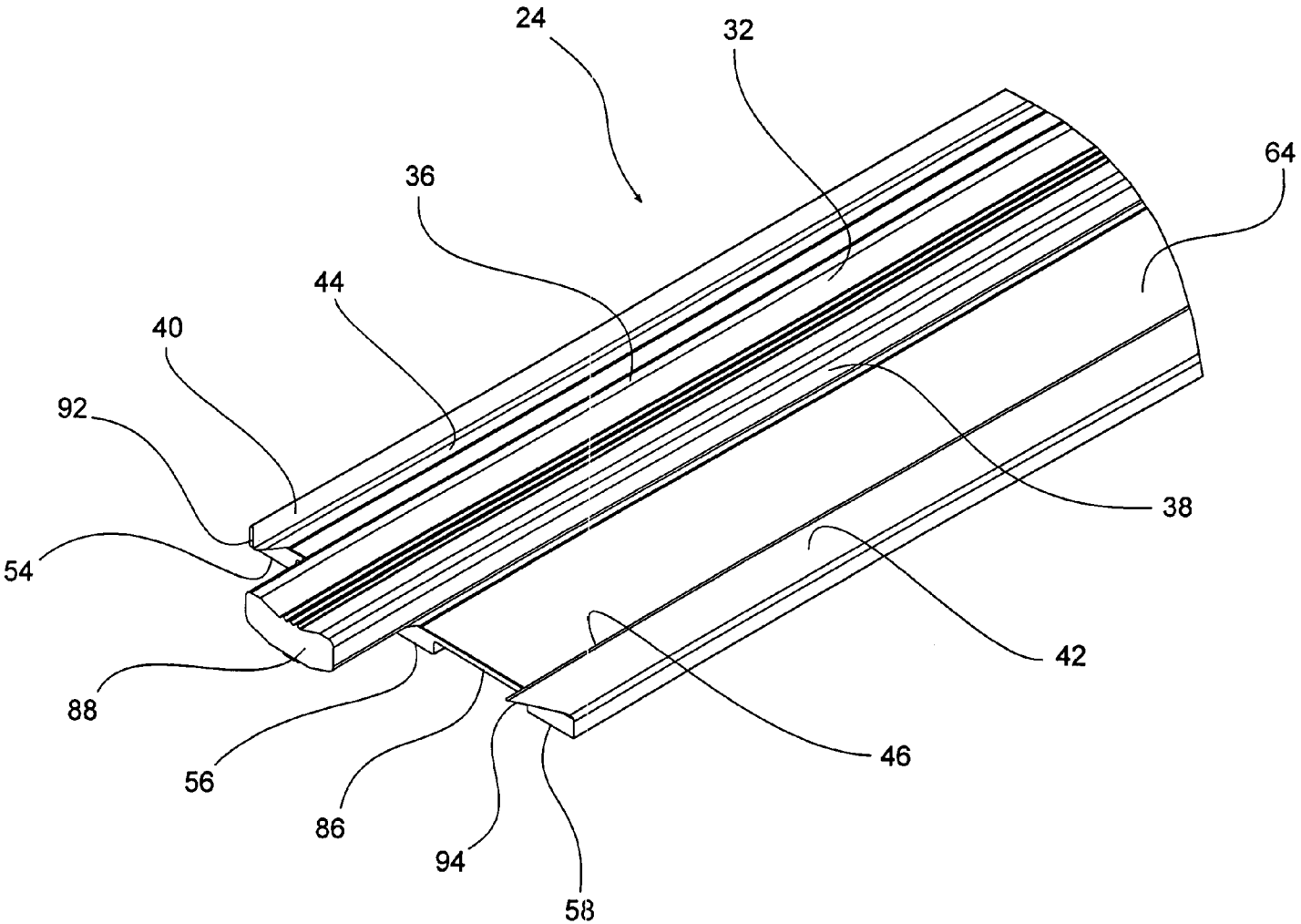
Figure 16:
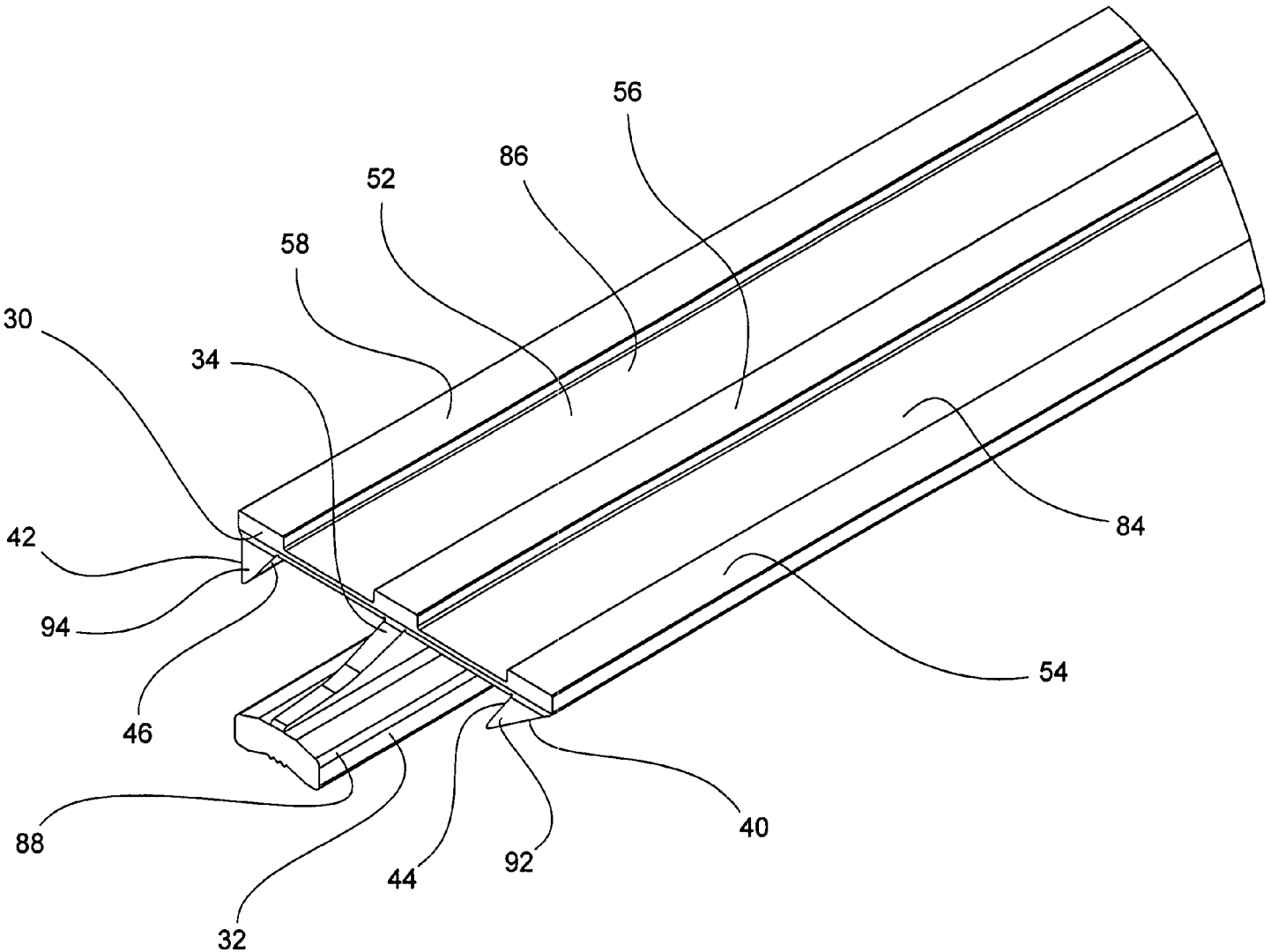

With this in mind, an alternate long track locking strip 124 is provided for use along the long sides 18*b* of the flooring panel 10. The long track locking strip 124 is substantially identical to the previously described short track locking strip 24 with the exception of the footing members 54, 56, 58. As such, and with reference to FIGS. 5 and 10 to 13, the long track locking strip 124 includes a base 130, a projection 132 having a central stem 134 with first and second outwardly extending members 136, 138 extending therefrom, and first and second protrusions 140, 142, spaced apart from, and on either side of, the projection 132 projecting upwardly from base 130. The first and second protrusions 140, 142 are preferably rounded on the top portion as shown, and taper away, i.e., decrease in height, as they move away from the center of the base 130 toward the edge of the base 130. Thus, the portion of the first and second protrusions 140, 142 closest to the center of the base 130, and projection 132, extend the greatest distance vertically, forming a central facing surface 144, 146 on each of the protrusions 140, 142. By forming the first and second protrusions 140, 142 with central facing surfaces 144, 146, they "grip" the grooves 26 of adjacent panels 10 and prevent the adjacent panels 10 from moving apart. In other words, and as shown in FIG. 5, the central facing surfaces 144, 146 of the first and second protrusions 140, 142 engage the outer walls 48 of the respective grooves 26 to prevent the adjacent panels 10 from moving in a direction laterally away from the long track locking strip 124 to which they are bound.

As with the short track locking strip 24, the structural stability of the long track locking strip 124 is enhanced by the provision of concave recesses 150 at the respective junctions between the base 130 and the projection 132, and the base 130 and the first and second protrusions 140, 142. The concave recesses 150 enhance stability and connection tolerances by creating rounded transitions between the base 130 and the projection 132, first protrusion 140 and second protrusion 142.

The underside 152 of the base 130 is further formed with slight recesses 131 (approximately 0.006 inches in accordance with a preferred embodiment of the present invention) extending respectively between the first and second protrusions 140, 142. These recesses 131 enhance the flexibility of the long track locking strip 124 and prevent bending of the base 130 as the base 130 slightly, but necessarily, flexes upon the coupling of a flooring panel 10 to the long track locking strip 124 in the manner described below in greater detail.

The flooring panels 10 used in accordance with the present invention preferably include an edge profile 20 with dados 22 shaped to receive the first and second outwardly extending members 36, 38, 136, 138 of the short or long track locking strip 24, 124 such that the visible flooring surface only includes the top decorative layer 12 when the flooring panels 10 are connected. The outwardly extending members 36, 38, 136, 138 and panel dados 22 are formed to vertically connect adjacent flooring panels 10 when two flooring panels 10 are joined together using the disclosed short or long track locking strip 24, 124. That is, if two flooring panels 10 are connected at their edges 18, the edges 18 of the opposing flooring panels 10 do not move up or down (vertically) relative to each other and, thus, provide a level uniform seam between the adjacent flooring panels 10. Similarly, and where the flooring panels 10 are not secured to a horizontal support surface, the connected flooring panels 10 are engaged against movement relative to each other in a direction substantially perpendicular to the plane in which the decorative surface layer 12 of the flooring panels 10 lie.

In addition to the vertical connection provided by the outwardly extending members 36, 38, 136, 138, and as discussed above, the flooring panels 10 and track locking strip 24, 124 are shaped to provide a horizontal connection between adjacent flooring panels 10 at their edges 18. Specifically, the track locking strip 24, 124 is provided with protrusions 40, 42, 140, 142 shaped and dimensioned to securely fit within grooves 26 found in the bottom surface 28 of the flooring panel 10. The protrusions 40, 42, 140, 142 are formed to prevent adjacent flooring panels 10 from moving in a horizontal plane when the flooring panels 10 are properly seated on the track locking strip 24, 124. For example, and according to one embodiment, the connected flooring panels 10 are engaged against movement relative to each other in a direction horizontal to the support surface. That is, if two flooring panels 10 are connected at their edges 18, the interaction between the respective grooves 26 and protrusions 40, 42, 140, 142 prevents the edges 18 from moving horizontally away from each other and a gap between adjacent flooring panels 10 is prevented.

The ability of the present track locking strip 24, 124 to prevent both horizontal and vertical movement of the adjacent flooring panels 10 is a direct result of the cooperating nature of the first and second protrusions 40, 42, 140, 142 and the outwardly extending members 36, 38, 136, 138. Specifically, the bottom surface 68, 70, 168, 170 of both the first and second outwardly extending members 36, 38, 136, 138 is angled downwardly as it extends toward the stem 34, 134 of the central projection 32, 132, and includes a flat portion 72, 74, 172, 174 adjacent the stem 34, 134 of the central projection 32, 132. In addition, the vertical distance between the flat portions 72, 74, 172, 174 of the bottom surface 68, 70, 168, 170 of the respective outwardly extending members 36, 38, 136, 138 and the flat portion 76, 78, 176, 178 along the topside 80, 82, 180, 182 of the respective outwardly extending members 36, 38, 136, 138 is substantially equal to the height of the dado 22 formed in the edge profile 20 of the flooring panels 10. This spacing holds the flooring panels 10 in place and substantially prevents the flooring panels 10 from moving up and down. Since the distance from the dado 22 to the upper surface 62 of the flooring panel 10 is always the same, the connected flooring panels 10 will provide a level, uniform seam between the adjacent flooring panels 10.

Controlled positioning of the flooring panels 10 is further provided by ensuring that the protrusions 40, 42, 140, 142 are always spaced the same distance from the upper surface 62 of the flooring panels 10 regardless of the flooring panel 10 thickness. This is accomplished by adjusting the depth of the grooves 26 based upon the thickness of the flooring panel 10 (for example, a thicker flooring panel will be cut with a deeper groove and a thinner flooring panel will be cut with a shallower groove). As a result, the distance from the grooves 26, to the upper surface 62 of the flooring panel 10 and the distance from the protrusions 40, 42, 140, 142 to the upper surface 62 of the flooring panel 10 are always the same regardless of the thickness of the flooring panel 10. Thus, connected flooring panels 10 will always exhibit a level uniform seam between the adjacent flooring panels 10.

These features, in combination with the first and second protrusions 40, 42, 140, 142 discussed above, provide a secure, selectively releasable coupling between the track locking strip 24, 124 and flooring panels 10 secured thereto. In practice, as a flooring panel is being secured to the track locking strip 24, 124, the outer/horizontal edge (only two shown) of the flooring panel dado 22 receives the outwardly extending member 36, 38, 136, 138 of central projection 32, 132. As the flooring panel 10 is pushed toward the stem 34, 134 of the central projection 32, 132, the bottom surface 68, 70, 168, 170 of the outwardly extending member 36, 38, 136, 138, forces the flooring panel 10 downwardly toward the base 30, 130 of the track locking strip 24, 124 by engaging the bottom wall of the dado 22. Movement in this way is further facilitated by sloping the topside 80, 82, 180, 182 of the outwardly extending member 36, 38, 136, 138 downward as it extends toward the stem 34, 134 of the central projection 32, 132. This continues until the bottom wall of the dado 22 reaches the flat portion 72, 74, 172, 174 along the bottom surface 68, 70, 168, 170 of the outwardly extending member 36, 38, 136, 138.

At this point, the downward pressure applied by the outwardly extending member 36, 38, 136, 138 forces the flooring panel 10 downward such that the protrusion 40, 42 140, 142 is seated within the groove 26 with the central facing surface 44, 46, 144, 146 engaging the outer wall 48 of the groove 22 to prevent the flooring panels 10 from moving in a direction laterally away from the track locking strip 24, 124 to which they are bound. In addition, the fact that the height of the dado 22 is slightly larger than the spacing between the flat portions 72, 74, 172, 174 of the bottom surface 68, 70, 168, 170 and topside 80, 82, 180, 182 of the outwardly extending member 36, 38, 136, 138, ensures that the outwardly extending member 36, 38, 136, 138 snuggly fits within the to prevent vertical movement of the flooring panel 10.

In accordance with a preferred embodiment of the present invention, and as discussed above, the short track locking strips 24 with footing members 54, 56, 58 are used in conjunction with the short sides 18*a* of the flooring panels 10 and the long track locking strips 124 are used in conjunction with the long sides 18*b* of the flooring panels 10. In this way, optimal connection between adjacent flooring panels 10 is achieved.

The embodiments described above employ track locking strips 24, 124 preferably formed via extrusion of aluminum. However, and in accordance with an alternate preferred embodiment of the present invention, the short and long track locking strips 24, 124 may be constructed from plastic via injection molding techniques. However, current injection molding technology will likely limit the applicability of injection molding to the manufacture of only the short track locking strip. As technology advances it is certainly contemplated that the long track locking strips may be manufactured via injection molding of plastic, incorporating the many advantages associated with injection molding as discussed below. In general, injection molding of plastic obviates deformation problems associated with aluminum track locking strips and takes advantage of the manufacturing tolerances offered by injection molding.

With the exception of various details, the short track locking strips 24 manufactured via the injection molding of plastic are similar to those previously described with reference to FIGS. 6 to 9. As such similar reference numerals will be utilized where the parts are substantially the same.

With reference to FIGS. 14 to 18, the track locking strip 24 includes a base 30, a projection 32 having a central stem 34 with first and second outwardly extending members 36, 38 extending therefrom, and first and second protrusions 40, 42 spaced apart from, and on either side of, the projection 32 projecting upwardly from base 30. The first and second protrusions 40, 42 are preferably rounded on the top portion as shown, and taper away, i.e., decrease in height, as they move away from the center of the base 30 toward the edge of the base 30. Thus, the portion of the first and second protrusions 40, 42 closest to the center of the base 30, and projection 32, extend the greatest distance vertically, forming a central facing surface 44, 46 on each of the protrusions 40, 42. By forming the first and second protrusions 40, 42 with central facing surfaces 44, 46, they "grip" the grooves 26 of adjacent flooring panels 10 and prevent the adjacent flooring panels 10 from moving apart. The central facing surfaces 44, 46 of the first and second protrusions 40, 42 engage the outer walls 48 of the respective grooves 26 to prevent the adjacent flooring panels 10 from moving in a direction laterally away from the track locking strip 24 to which they are bound.

In contrast to the aluminum track locking strips described above, it is possible to increase the height of the protrusions 40, 42 so as to enhance the gripping of the grooves 26 of the flooring panels 10. The ability to increase the height of the protrusions 40, 42 is due to that fact that the injection molded plastic is more resilient than the aluminum and, therefore, will not permanently deform when bent during the insertion of the flooring panel 10. As such, it is possible that the height of the protrusions 40, 42, and consequently the mating size of the grooves 26, may be increased to enhance the gripping action between the protrusions 40, 42 and the grooves 26.

As with the short track locking strip 24 described with reference to FIGS. 6 to 9, the structural stability of the track locking strip 24 is enhanced by the provision of concave recesses (not shown) at the respective junctions between the base 30 and the projection 32 and the base 30 and the first and second protrusions 40, 42. The concave recesses enhance stability by creating rounded transitions between the base 30 and the projection 32, first protrusion 40 and second protrusion 42.

The base 30 includes an underside 52 with a plurality of downwardly extending footing members 54, 56, 58. The recesses 84, 86 between the footing members 54, 56, 58 are substantially concave. In accordance with an alternate embodiment, it is contemplated the recesses may be curved surfaces. It is believed that such curved surfaces may relieve stresses inherent in the use of the plastic track locking strip and support the plastic as it compresses the underlying foam pad. In addition, such curved surfaces would allow for selective disengagement of the flooring panels by permitting controlled flex of the track locking strip. It is further contemplated that rectangular profiles may be formed in the concave recesses; for example, every 0.25 inch along the length of the track locking strip. It is believed the inclusion of such rectangular profiles within the curved surfaces of the concave recesses would more readily permit the track locking strip to compress into the underlying foam pad. In addition, it is contemplated the recesses may be formed with alternating, different curved profiles without departing from the spirit of the invention. As those skilled in the art will appreciate, other profiles not contemplated may be employed without departing from the spirit of the invention.

The footing members 54, 56, 58 extend downwardly from positions directly beneath the first protrusion 40, the projection 32 and the second protrusion 42. Briefly, and as discussed above with regard to the embodiment described with reference to FIGS. 6 to 9, the downwardly extending footing members 54, 56, 58 allow the track locking strip 24 to compress a foam pad 60 commonly positioned beneath a flooring system installed in accordance with the present invention. By permitting the track locking strip to compress a foam pad 60, seams between adjacent flooring panels 10 are securely held together, even when the flooring is constrained under force being applied from the upper surface 62 thereof.

As briefly mentioned above, the track locking strips 24 with footing members 54, 56, 58 are best applied along the end seams, or short sides 18*b*, of adjacent flooring panels 10. The desired use of the track locking strips 24 with footing members 54, 56, 58 results from the fact that greater downward pressure is encountered along the end seams of a constrained flooring panel 10, that is, the pressure necessary to compress the footing members 54, 56, 58 into the underlying foam pad 60 is generally only found along the end seams.

Figure 17:
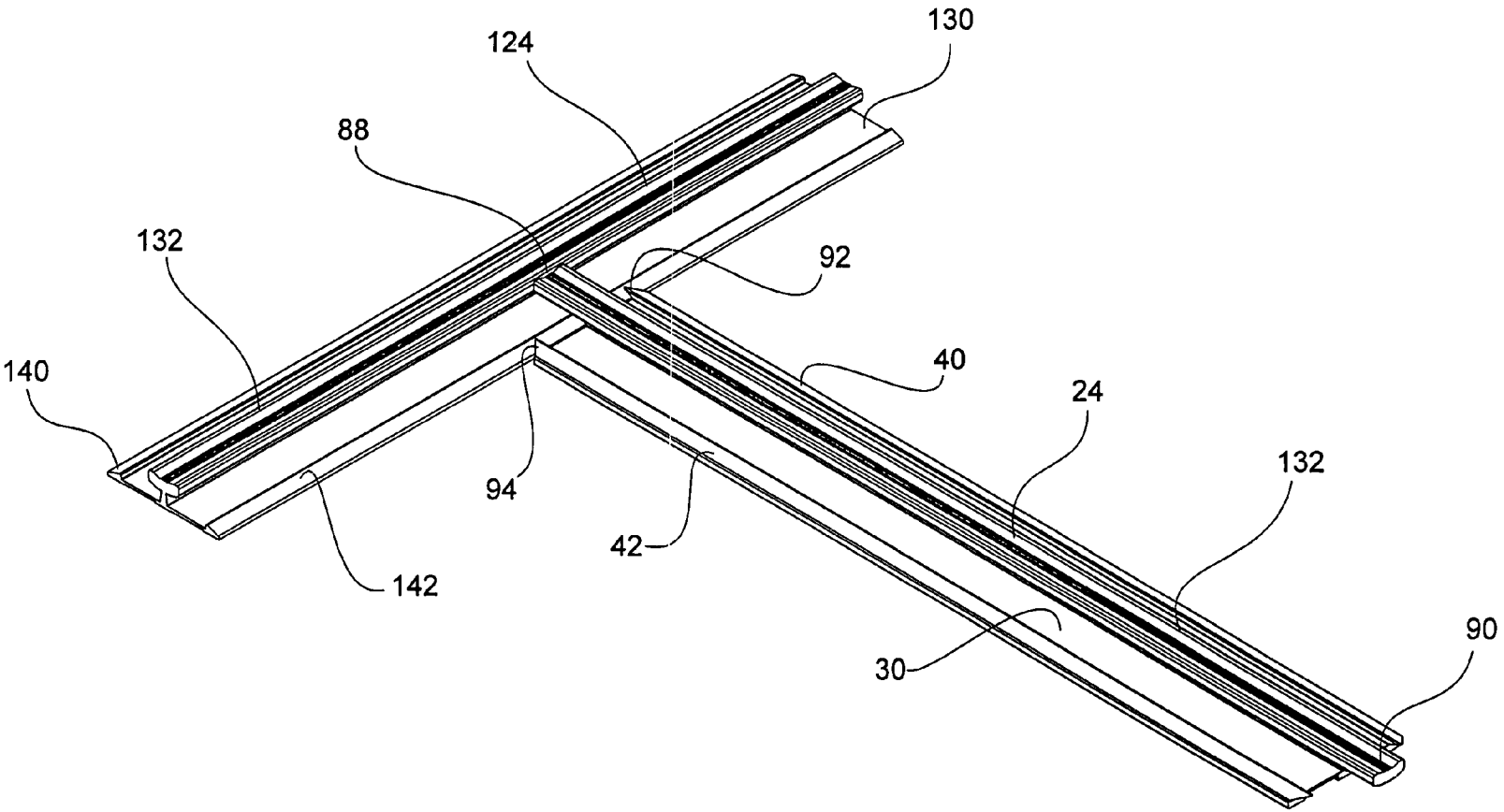
FIG. 17 is a perspective view showing use of the track locking strip of FIGS. 14-16 in conjunction with the track locking strip of FIGS. 10-13.
Figure 18:
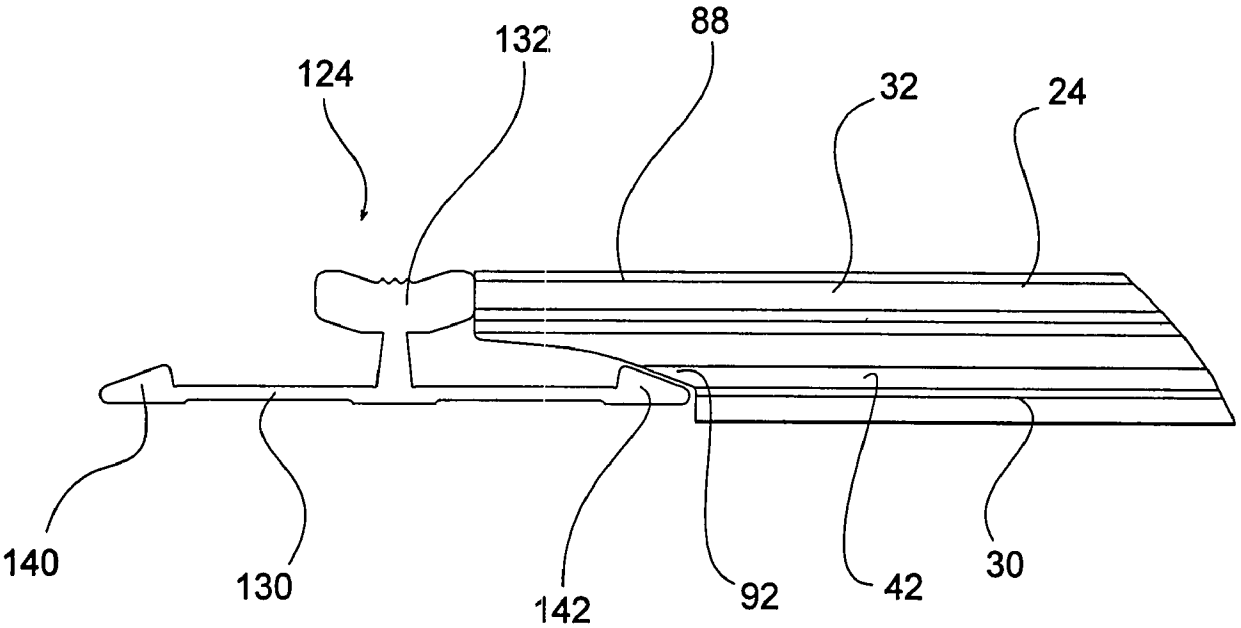
FIG. 18 is a side view showing use of the track locking strip of FIGS. 14-16 in conjunction with the track locking strip of FIGS. 10-13.
Figure 19:
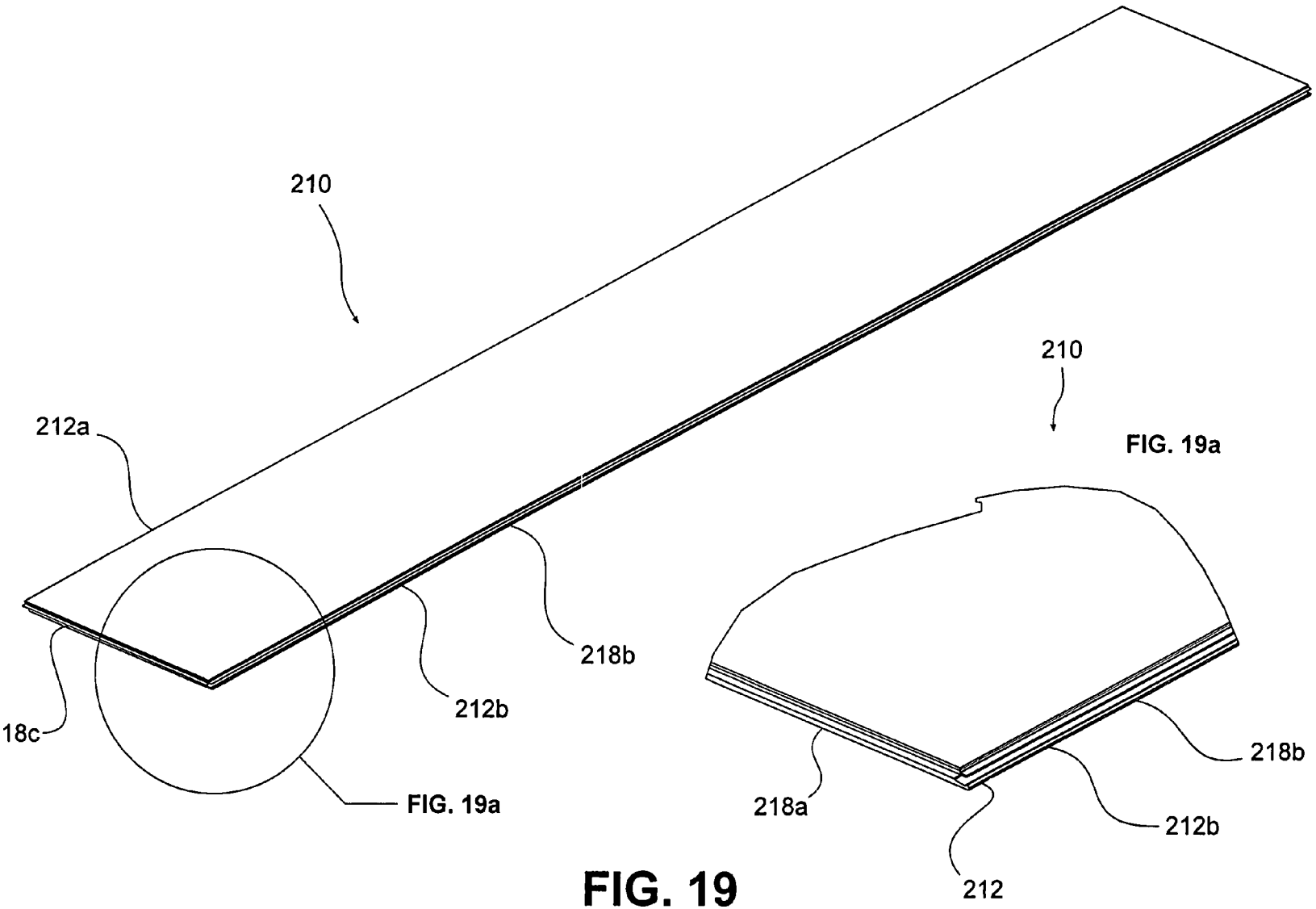
FIG. 19 is a top perspective view of a flooring panel in accordance with an alternate embodiment of the present invention.
Figure 20:
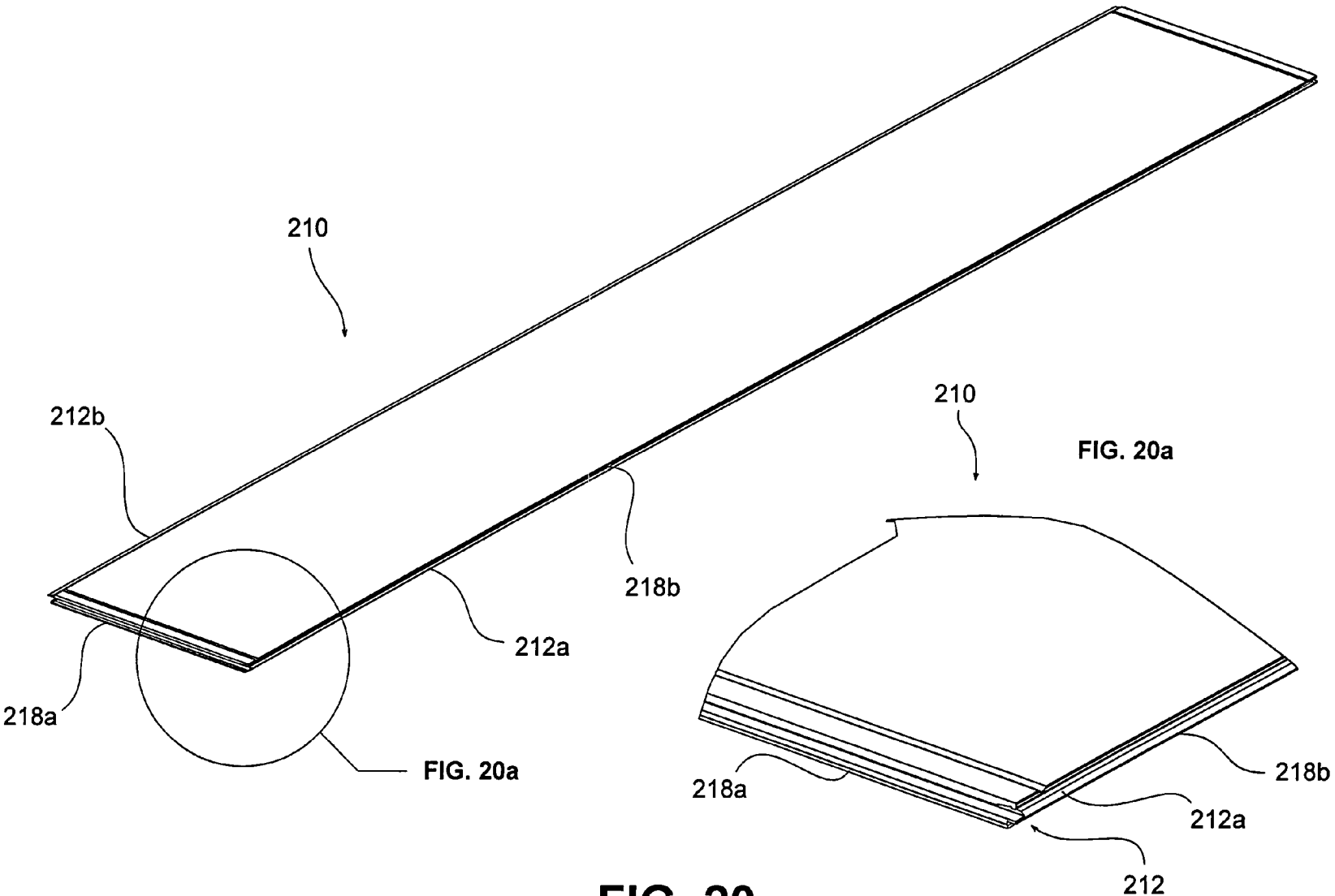
FIG. 20 is a bottom perspective view of the flooring panel shown in FIG. 19.
Figure 21:
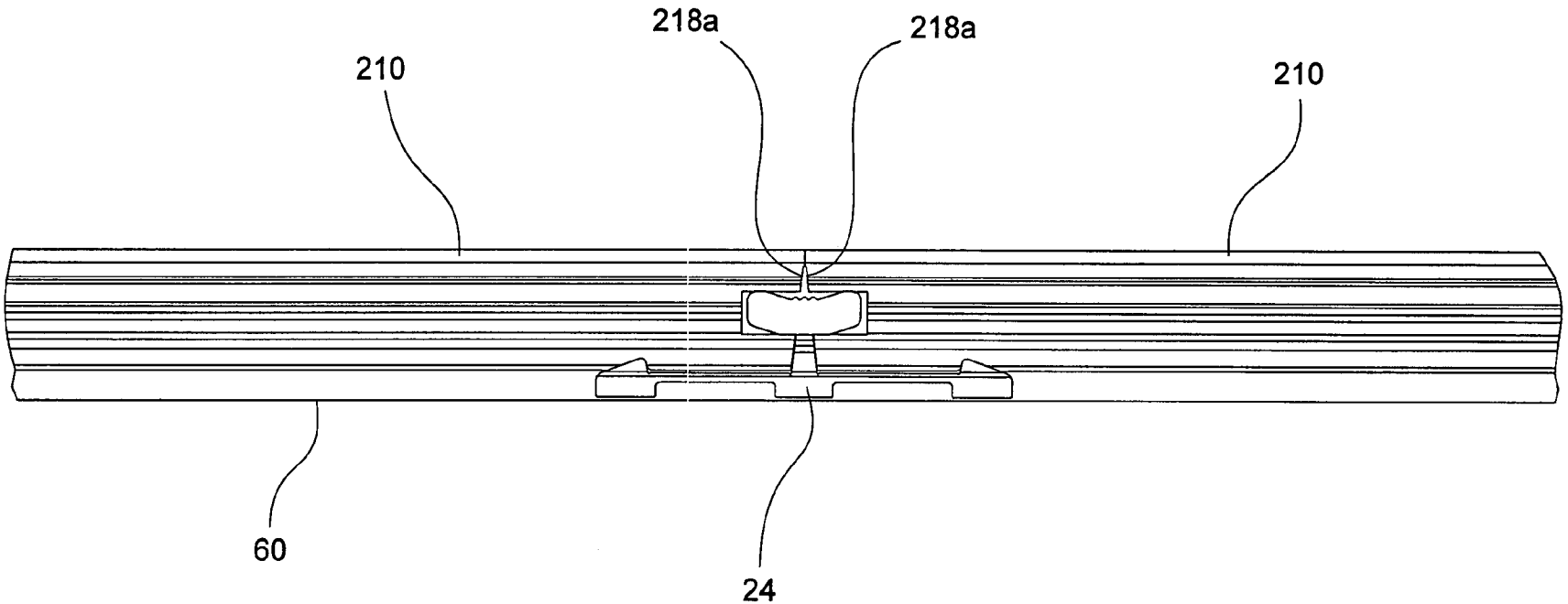
FIG. 21 is a cross sectional view of an end seam in accordance with the flooring panel shown in FIGS. 19 and 20.
Figure 22:
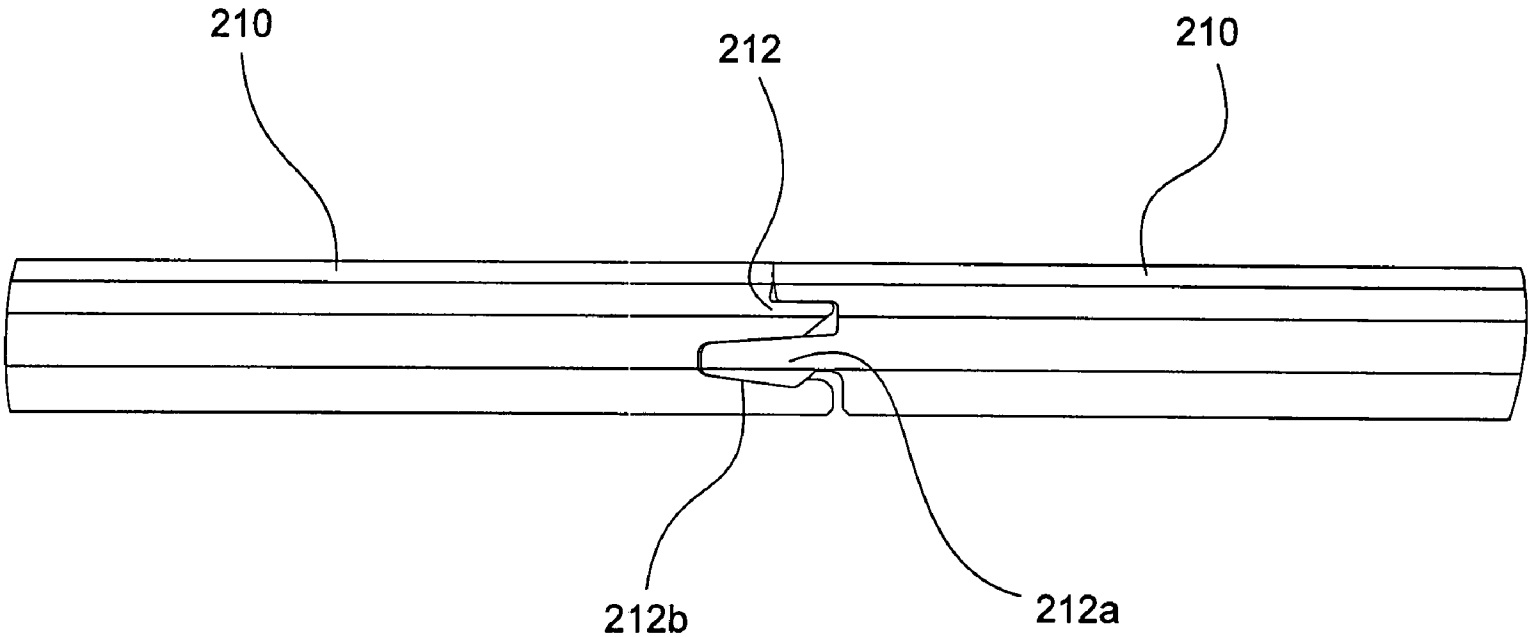
FIG. 22 is a cross sectional view of a side seam in accordance with the flooring panels shown in FIGS. 19 and 20.

The present track locking strip 24 is further differentiated from that disclosed above with reference to FIGS. 6 to 9, in that the track locking strip 24 is provided with outwardly extending ears 88, 90 along each end of the track locking strip 24. The outwardly extending ears 88, 90 extend beyond the base 30 of the track locking strip 24. In particular, the ears 88, 90 extend from the base 30 and are substantially extensions of the outwardly extending members 36, 38 of the projection 32. As such, the ears 88, 90 are shaped and dimensioned to fit within the edges 18 of the flooring panels 10 in a manner similar to the extending members 36, 38 sitting directly above the base 30. However, and because the base 30 does not sit beneath the ears 88, 90, the ears 88, 90 permit perpendicular engagement between track locking strips 24, 124 as shown in FIGS. 17 and 18.

When it is necessary to angularly orient a short track locking strip 24 relative to a long track locking strip 124, it is desirable that contact between the short track locking strip 24 and the flooring panel 10 be enhanced. The provision of the ears 88, 90 permits contact between the short track locking strip 24 and the short side 18*a* of the flooring panel 10 along substantially the entire short side 18*a* of the flooring panel 10. As those skilled in the art will certainly appreciate, without the ears, the bases 30, 130 of adjacent track locking strips 24, 124 will abut, preventing the projection 32 from coupling with the flooring panel 10 along the space between the projection 32 of the short track locking strip 24 and the projection 32 of the perpendicularly oriented long track locking strip 124. Although the advantages of the ears 88, 90 are described above with reference to perpendicularly oriented track locking strips, the advantages may still apply to situations wherein the track locking strips are oriented in other angular orientations.

In addition to the ears 88, 90, interaction between the track locking strip 24 and the adjacent track locking strip 124 is enhanced by the provision of extending locking tabs 92, 94 along the protrusions 40, 42. The locking tabs 92, 94 extend over the adjacent protrusion 142 to enhance engagement of adjacent flooring panels 10. Although the locking tabs 92, 94 are shown covering one of the protrusion 142 of the adjacent track locking strip 124, those skilled in the art will appreciate the locking tabs 92, 94 may be employed on either side of the track locking strip 124.

In summary, the injection molded plastic track locking strips 24 offer a variety of advantages over the aluminum track locking strips. For example, they permit tighter tolerances and, thereby, permit design refinements requiring tighter tolerances. In addition, the protrusions may be made higher, improving engagement with the grooves of flooring panels. Further, injection molding procedures are commonly more easily monitored than the extrusion process contemplated for use in accordance with the aluminum embodiment.

Various non-limiting embodiments of the track locking strip of the present invention have been described and the flooring panels of the present invention are necessarily configured, for example, to correspond to these track locking strips to achieve the advantages of the present invention. It should be understood that the flooring panels may be configured to provide an exact fit with the track locking strip or a non-exact fit as long as the advantages of the present invention are achieved. For example, where a permanent structure is desired, an embodiment allowing space for glue to accumulate between the flooring panels and the track locking strip may be appropriate. In addition, and especially when a temporary structure is desired, it might be undesirable for the flooring panels and track locking strip to fit together exactly when utilizing certain reinforcing substrate materials. For example, some space between certain portions of the track locking strip projections and the recesses of the flooring panels can be tolerated as long as the advantages of the invention are achieved.

The flooring panels are constructed such that they disengageably interconnect with the track locking strip of the present invention. That is, while the track locking strips and flooring panels are securely connected to perform the function of a flooring surface, the flooring panels can, if desired, be removed by lifting a flooring panel and pulling the flooring panel away from the track locking strip to disengage the flooring panel/strip interconnection.

The flooring panels of the present invention are constructed to always form a tight uniform level seam between adjacent flooring panels when connected together utilizing the track locking strip of the present invention. The flooring panels are constructed such that the depth of the grooves in the bottom surface of each flooring panel are always a certain distance from the top wear surface, i.e., the exposed portion of the decorative surface layer. As stated above, these grooves are shaped to receive a protrusion projecting from the base of the track locking strip to disengageably interconnect two flooring panels together horizontally. Thus, both flooring panels rest on the track locking strip at the interconnection point where the respective protrusions meet the grooves. With this in mind, and as discussed above, this arrangement provides a system wherein the distance from the grooves to the upper surface of the flooring panel and the distance from the protrusions to the upper surface of the flooring panel are always the same regardless of the thickness of the flooring panel. Thus, connected flooring panels will always exhibit a level uniform seam between the adjacent flooring panels.

Consequently, even when the support structure or ground floor is uneven or not level, the seam is always tight, uniform and level. Even if the thickness of the flooring panels vary, a uniform level seam is provided when two flooring panels are interconnected because the depth of the grooves in the bottom surface of each flooring panel is formed to be a certain distance from the top wear surface. Therefore, the top wear surfaces of two adjacent flooring panels will always come to rest at the same level, i.e., a certain distance from the base protrusions of the track locking strip. Preferably, the flooring panels of the present inventive system range in thickness from about 0.610 cm to about 0.813 cm.

The system of the present invention also provides flooring panels that utilize substantially the entire manufactured laminate top wear surface to yield an economic advantage over many prior art systems. In prior art systems, a flooring panel is manufactured with a top wear surface. After manufacture, the flooring panel is machined at the edges to remove a portion of the top wear surface and form a tongue extension for insertion into a corresponding groove of an adjacent flooring panel. To form the tongue, the top wear surface must be machined off. This decreases the marketable square footage of flooring per flooring panel. In addition, the removal of more top wear surface accelerates tool wear. Tools, therefore, require more maintenance and/or replacement. Consequently, the cost and time of manufacture increases.

Utilizing the system of the present invention, the amount of top wear surface of the flooring panels that must be machined is greatly reduced. Substantially the entire manufactured decorative top wear surface is sold to the end user eliminating waste experienced in prior art systems. As a result, the total square footage of saleable flooring produced by a plant is increased and costs are reduced.

In addition, the track locking strips of the present invention are not fixed to the flooring panels at the factory and thus, no adhesive or other fastening means is required to be applied again, reducing material costs, labor costs, and time to manufacture.

The system of the present invention also provides flooring panels that are less susceptible to damage than prior art tongue and groove systems. For example, it is known that the tongues of flooring panels are susceptible to damage during shipping, handling, and even assembly and disassembly. If a tongue is broken off or substantially deformed, it will not engage the groove of an adjacent flooring panel and is rendered useless. The flooring panels of the present invention do not include tongues they only have recesses and/or grooves formed therein. It is difficult, if not impossible, to damage a recess or groove during shipping, handling, assembly and disassembly. Thus, the flooring panels of the present invention are more durable than many prior art flooring panels. This is a significant advantage when flooring panels are used in floating floor surfaces and temporary flooring constructions that will be removed and reassembled many times. The system of the present invention provides track locking strips (preferably made from metal) which are fairly tough, as well as easy and economical to replace, when compared to the cost of a new flooring panel. The present inventive system substantially reduces, if not eliminates, the risk of damaging a flooring panel to the extent that it is inoperable.

The flooring system of the present invention provides a flooring surface that is easy to repair and/or change. For example, many prior art systems (see the systems disclosed in U.S. Pat. Nos. 5,706,621 and 5,860,266) require holding the new flooring panel to be joined at an angle relative to a principal plane of a first laid flooring panel and angling down the new flooring panel to become mechanically locked underneath a portion of the first flooring panel. This is repeated until a floor is constructed. If the fifth flooring panel in a sequence of 20 flooring panels needs to be replaced, e.g., due to damage, flooring panels 6 through 20 must be removed in reverse order to reach flooring panel 5. Utilizing the system of the present invention, which does not require the angling down of each new flooring panel underneath a portion of an existing flooring panel, flooring panels 1 through 4 of the sequence can be removed and flooring panel 5 replaced. Thus, the present inventive system substantially reduces the time and aggravation of removing and replacing flooring panels. In addition, due to the fact that the flooring panels of the present inventive system do not require a single directional laying sequence, more than one person can construct different portions of a single flooring surface simultaneously. This is especially advantageous in relation to the installation of large flooring surfaces, e.g., retail spaces.

The flooring panels of the present inventive system also provide substantially more aesthetic flexibility than prior art flooring panels. For example, since the flooring panels are not right or left handed, i.e., one or unidirectional, but instead are multidirectional due to each edge being identical, each individual flooring panel can be placed into a flooring surface being constructed in the most eye-appealing manner. Moreover, the flooring panels of the present inventive system allow for flexibility in designing and constructing parquet-type flooring surfaces. For example, it is known that a flooring panel is usually manufactured wherein the grain runs in the machine direction. However, since the flooring panels of the present invention are multidirectional, the direction of the grain on the flooring surface can be easily alternated to form a parquet floor, or a floor of any grain design.

The flooring panels of the present inventive system also reduce waste during floor construction. Typically, when constructing a flooring surface using prior art systems with handed flooring panels, the construction starts at one wall and proceeds across the space to the other wall. A space to be floored is normally not of a dimension which is equally divisible by the size of a flooring panel, i.e., flooring panels at an end wall have to be cut length or width wise to fit. In prior art systems utilizing handed flooring panels, there is a substantial possibility that the remaining portion is unusable once the flooring panel is cut. For example, in a prior art system utilizing rectangular flooring panels with tongues and grooves on opposing intersecting edges respectively, two flooring panel pieces are formed with one long edge of each either being a tongue or a groove when a flooring panel is cut lengthwise. At the end wall a portion of a flooring panel may be needed with a groove on the long edge and it is inserted. As a result, only a flooring panel piece having a tongue on the long edge remains without a long groove edge.

However, with the flooring panels of the present invention, i.e., each flooring panel is constructed with grooves on all edges, any flooring panel portion remaining after completing the floor up to a portion of the end wall is also usable to complete another portion of the floor up to the end wall.

The flooring panels of the present inventive system are constructed such that it is not necessary to hold one flooring panel at an angle relative to the other flooring panel and angle down the new flooring panel into place when assembling two flooring panels together. The fact that the flooring panels can be interconnected by forcing two together while they are lying in the same plane is very advantageous in relation to constructing certain portions of flooring surfaces challenged by various physical boundaries, e.g., the interface between a flooring surface and a fireplace.

Though it can be envisioned that the track locking system may be used with traditional laminate floors or with all wood floors, one can understand the advantages of the decorative laminate flooring panels manufactured in accordance with the present invention to offer a substantially water resistance edge. The thermoplastic edge member seals the cut edge of the substrate. This protects the wood-based substrate from the undesirable effects resulting from exposure to moisture. In this way, decorative laminate flooring panels in accordance with the present invention are not subject to the negative effects imposed as moisture seeps between the adjacent flooring panels and into the substrate positioned between the decorative surfacing layer and the backing layer.

In accordance with still a further embodiment of the present invention, and with reference to FIGS. 19, 19*a*, 20, 20*a*, 21 and 22, the track locking strips 24 of the present invention may be employed in combination with more traditional "tongue and groove" locking systems. In particular, it is well known to those skilled in the art that end seams of flooring panels 210 are most susceptible to disengagement under highly constrained conditions. As such, and in accordance with an alternate embodiment, the connection system employing track locking strips 24 with footing members 54, 56, 58 is utilized along the end seams of adjacent flooring panels 210, while traditional glue or glueless "tongue and groove" connection systems 212 are employed along the long sides 218*b* of the flooring panels 210.

In accordance with a preferred embodiment, the end seams, that is, the short ends 218*a*, of the flooring panels 210 are constructed as described above for engagement with the track locking strips 24 with footing members 54, 56, 58. However, the long sides 218*b* of the flooring panel 210 are formed with a glueless tongue and groove structure 212*a*, 212*b* such as that disclosed in commonly owned U.S. Pat. No. 6,332,733, entitled "JOINT", which is incorporated herein by reference. As such, one long side 218*b* of the flooring panel 210 is formed with a tongue 212*a* and the opposite long side 218*b* of the flooring panel 210 is formed with a groove 212*b* shaped and dimensioned for engaging the tongue 212*a*. As such, long sides 218*b* of the flooring panel 210 are connected using traditional tongue and groove techniques, while track locking strips 24 are employed in the connection of the end seams of adjacent flooring panels 210.

While the preferred embodiments have been shown and described, it will be understood that there is no intent to limit the invention by such disclosure, but rather, is intended to cover all modifications and alternate constructions falling within the spirit and scope of the invention as defined in the appended claims.

The invention claimed is:

1. A disengageable connector for interconnecting panels, the connector comprising;

a longitudinally extending connector body having a substantially similar profile along its entire length, the connector body including a base and a projection extending from the base;

the base includes a top surface and a bottom surface, the bottom surface being composed of an underside consisting essentially of a first footing member extending downwardly from the bottom surface of the base, a second footing member extending downwardly from the bottom surface of the base and a third footing member extending downwardly from the bottom surface of the base; and a first protrusion extending vertically from the base adjacent a first edge of the base and a second protrusion extending vertically from the base adjacent a second edge, opposite the first edge, of the base, the first protrusion and the second protrusion are spaced apart from the projection and are located on either side of the projection;

wherein the first footing member and the second footing members are respectively positioned beneath the first protrusion and the second protrusion, and the third footing member is positioned beneath the projection, the first footing member, the second footing member and the third footing member being spaced by a first recess extending fully between the first footing member and the third footing member and a second recess extending fully between the second footing member and the third footing member, and the first footing member, the second footing member and the third footing member are shaped and dimensioned to compress into an underlying foam pad to a predetermined limited extent such that the connector sits upon the underlying foam pad with the top surface of the base lying in substantially the same plane as the upper surface of the underlying foam pad.

2. The connector according to claim 1, wherein the projection extends vertically from the top surface of the base, the projection having top and bottom portions, and comprising right and left halves for insertion into edges of adjacent panels to be connected.

3. A disengageable connector for interconnecting panels, the connector comprising;

a longitudinally extending connector body having a substantially similar profile along its entire length, the connector body including a base and a projection extending from the base;

the base includes a top surface and a bottom surface, wherein the projection extends vertically upwardly from the top surface of the base, the projection having top and bottom portions, and comprising right and left halves for insertion into edges of adjacent panels to be connected extending upwardly from the base;

the bottom surface is composed of an underside consisting essentially of a first footing member extending downwardly from the bottom surface of the base, a second footing member extending downwardly from the bottom surface of the base and a third footing member extending downwardly from the bottom surface of the base;

a first protrusion extends vertically from the base adjacent a first edge of the base and a second protrusion extends vertically from the base adjacent a second edge, opposite the first edge, of the base, the first protrusion and the second protrusion are spaced apart from the projection and are located on either side of the projection beyond a lateral extent of the respective right and left halves of the projection, the first protrusion including a top portion and the first protrusion decreases in height as it extends from a center of the base toward an edge of the base and the second protrusion including a top portion and the second protrusion decreases in height as it extends from the center of the base toward an edge of the base; and wherein the first footing member and the second footing member are respectively positioned beneath the first protrusion and the second protrusion, and the third footing member is positioned beneath the projection, the first footing member, the second footing member and the third footing member being spaced by a first recess extending fully between the first footing member and the third footing member and a second recess extending fully between the second footing member and the third footing member, and the first footing member, the second footing member and the third footing member are shaped and dimensioned to compress into an underlying foam pad to a predetermined limited extent such that the connector sits upon the underlying foam pad with the top surface of the base lying in substantially the same plane as the upper surface of the underlying foam pad.

* * * * *

UNITED STATES PATENT AND TRADEMARK OFFICE

CERTIFICATE OF CORRECTION

PATENT NO. : 7,614,197 B2
APPLICATION NO. : 10/706947
DATED : November 10, 2009
INVENTOR(S) : Thomas J. Nelson It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1216 days.

Signed and Sealed this

Nineteenth Day of October, 2010

David J. Kappos

David J. Kappos
*Director of the United States Patent and Trademark Office*